US006893253B2

(12) United States Patent
Stretch et al.

(10) Patent No.: US 6,893,253 B2
(45) Date of Patent: May 17, 2005

(54) FUEL-FIRED HEATING APPLIANCE WITH TEMPERATURE-BASED FUEL SHUTOFF SYSTEM

(75) Inventors: Gordon W. Stretch, Oxnard, CA (US); Bruce A. Hotton, Montgomery, AL (US); John H. Scanlon, Montgomery, AL (US); Gary A. Elder, Montgomery, AL (US); James T. Campbell, Wetumpka, AL (US); Larry D. Kidd, Florence, SC (US); Eric M. Lannes, Kentwood, MI (US); Garrett Doss, Wyoming, MI (US); Michael W. Gordon, Grand Rapids, MI (US); James M. Martin, East Greenwich, RI (US); James W. Mears, Warwick, RI (US); Thomas E. Archibald, Providence, RI (US)

(73) Assignee: The Water Heater Industry Joint Research and Development Consortium, Rio Verde, AZ (US)

( * ) Notice: Subject to any disclaimer, the term of this patent is extended or adjusted under 35 U.S.C. 154(b) by 52 days.

(21) Appl. No.: 10/430,022

(22) Filed: May 5, 2003

(65) Prior Publication Data

US 2003/0196609 A1 Oct. 23, 2003

Related U.S. Application Data

(63) Continuation-in-part of application No. 10/200,234, filed on Jul. 22, 2002, now Pat. No. 6,715,451, which is a continuation-in-part of application No. 09/801,551, filed on Mar. 8, 2001, now Pat. No. 6,497,200.

(51) Int. Cl.[7] ..... F23N 5/00

(52) U.S. Cl. ..... 431/77; 431/78; 431/80; 431/33; 122/504; 122/504.1; 122/504.3; 126/287.5

(58) Field of Search ..... 122/13.01, 14.1, 122/14.2, 14.21, 504, 504.1, 504.3, 507; 431/12, 33, 66, 77, 78, 80; 126/112, 287.5

(56) References Cited

U.S. PATENT DOCUMENTS

| | | | |
|---|---|---|---|
| 1,834,645 | A | 12/1931 | Ryan |
| 2,122,426 | A | 7/1938 | Knight |
| 3,469,569 | A | 9/1969 | Brockbank |

(Continued)

FOREIGN PATENT DOCUMENTS

| | | | |
|---|---|---|---|
| EP | 0 040 373 | A1 | 11/1981 |

OTHER PUBLICATIONS

Star Sprinkler Catalog Sheets, dated Sep., 1992.
Battelle Final Report "Evaluation of Firexx . . . ", dated Aug. 15, 1994.

*Primary Examiner*—Jiping Lu
(74) *Attorney, Agent, or Firm*—Konneker & Smith, P.C.

(57) ABSTRACT

A gas-fired water heater is provided with a combustion shutoff system which precludes further combustion within the water heater's combustion chamber in response to a combustion temperature therein reaching a predetermined level correlated to and indicative of a predetermined, undesirably high concentration of carbon monoxide present in the combustion chamber. In various illustrated embodiments thereof, the combustion shutoff system is operative to terminate further combustion air inflow to the combustion chamber, or terminate further fuel flow to the burner portion of the water heater.

16 Claims, 13 Drawing Sheets

U.S. PATENT DOCUMENTS 3,625,289 A 12/1971 Gloeckler
3,633,676 A 1/1972 Gloeckler
3,777,696 A 12/1973 Bilbrey
3,779,004 A 12/1973 Gloeckler
3,874,456 A 4/1975 Gloeckler
4,290,440 A 9/1981 Sturgis
4,362,146 A 12/1982 Schuller
4,375,273 A 3/1983 Erb et al.
4,385,724 A * 5/1983 Ramsauer et al. ..... 236/25 A
4,627,498 A 12/1986 Aalto et al.
4,646,847 A 3/1987 Colvin
4,757,865 A 7/1988 Simons
4,827,962 A 5/1989 Picton
4,977,963 A 12/1990 Simons
5,072,792 A 12/1991 Simons et al.
5,134,683 A 7/1992 Powell
5,143,050 A 9/1992 Spivey
5,195,592 A 3/1993 Simons
5,234,059 A 8/1993 Eynon
5,280,802 A 1/1994 Comuzie, Jr.
5,372,203 A 12/1994 Galaszewski
5,402,603 A 4/1995 Henley
5,531,214 A * 7/1996 Cheek ..... 122/14.1
5,794,707 A 8/1998 Alhamad
5,797,355 A 8/1998 Bourke et al.
5,941,200 A 8/1999 Boros et al.
6,003,477 A 12/1999 Valcic
6,035,812 A 3/2000 Harrigill et al.
6,082,310 A 7/2000 Valcic et al.
6,085,699 A 7/2000 Valcic et al.
6,085,700 A 7/2000 Overbey, Jr.
6,116,195 A 9/2000 Valcic et al.
6,135,061 A 10/2000 Valcic et al.
6,138,613 A 10/2000 Bourke et al.
6,142,106 A 11/2000 Overbey, Jr.
6,155,211 A 12/2000 Valcic et al.
6,223,697 B1 5/2001 Overbey, Jr.
6,497,200 B2 * 12/2002 Stretch et al. ..... 122/504
6,540,504 B2 * 4/2003 Kobayashi et al. ..... 431/77
6,561,138 B2 * 5/2003 Kobayashi et al. ..... 122/14.2
6,715,451 B2 * 4/2004 Stretch et al. ..... 122/504
2001/0038986 A1 11/2001 Abraham et al.
2001/0042564 A1 11/2001 Abraham et al.
2002/0092234 A1 7/2002 Staller et al.

* cited by examiner

FIG.5
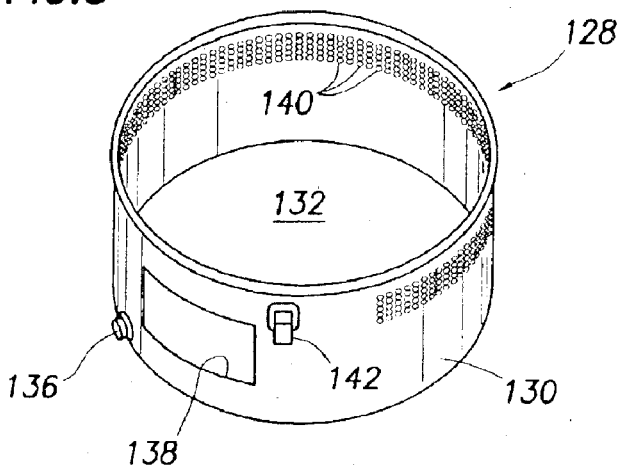
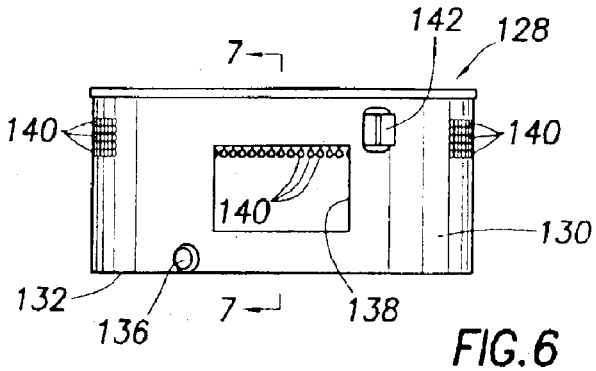
FIG.6
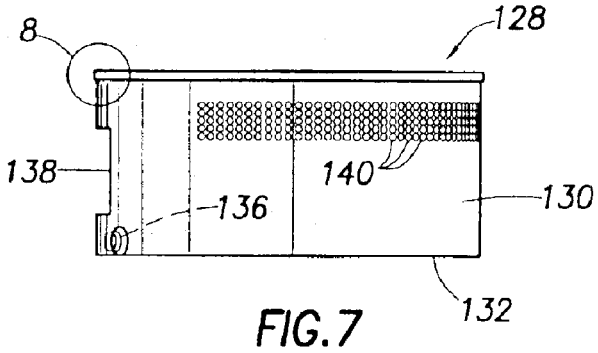
FIG.7
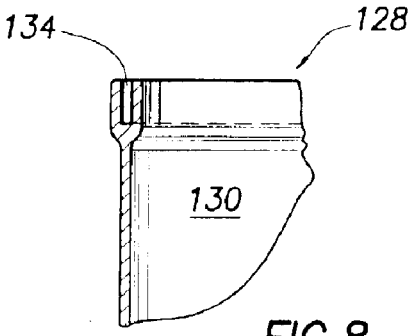
FIG.8
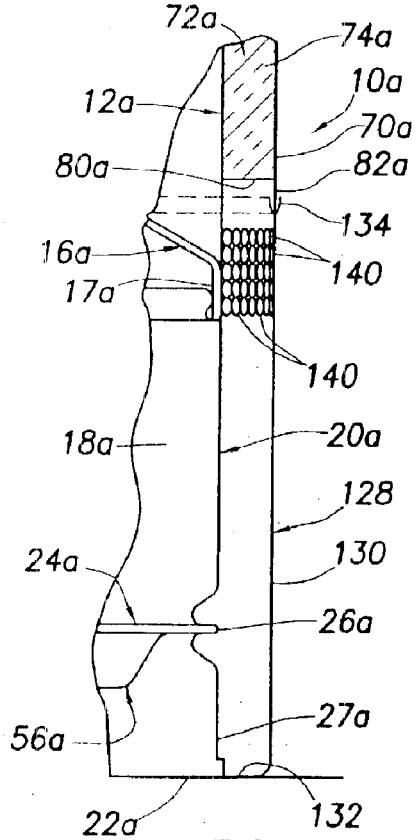
FIG.9

FUEL-FIRED HEATING APPLIANCE WITH TEMPERATURE-BASED FUEL SHUTOFF SYSTEM

CROSS-REFERENCE TO RELATED APPLICATIONS

This application is a continuation-in-part of U.S. application Ser. No. 10/200,234, filed on Jul. 22, 2002 now U.S. Pat. No. 6,715,451 and entitled "FUEL-FIRED HEATING APPLIANCE WITH COMBUSTION AIR SHUTOFF SYSTEM HAVING FRANGIBLE TEMPERATURE SENSING STRUCTURE", which was a continuation-in-part of U.S. application Ser. No. 09/801,551 filed on Mar. 8, 2001 and entitled "FUEL-FIRED HEATING APPLIANCE WITH COMBUSTION CHAMBER TEMPERATURE-SENSING COMBUSTION AIR SHUTOFF SYSTEM", now U.S. Pat. No. 6,497,200. The full disclosures of these previous applications are hereby incorporated herein by reference.

BACKGROUND OF THE INVENTION

The present invention generally relates to fuel-fired heating appliances and, in a preferred embodiment thereof, more particularly provides a gas-fired water heater having incorporated therein a specially designed combustion air shutoff system.

Gas-fired residential and commercial water heaters are generally formed to include a vertical cylindrical water storage tank with a gas burner disposed in a combustion chamber below the tank. The burner is supplied with a fuel gas through a gas supply line, and combustion air through an air inlet flow path providing communication between the exterior of the water heater and the interior of the combustion chamber.

Water heaters of this general type are extremely safe and quite reliable in operation. However, under certain operational conditions the temperature and carbon monoxide levels within the combustion chamber may begin to rise toward undesirable magnitudes. Accordingly, it would be desirable, from an improved overall control standpoint, to incorporate in this type of fuel-fired water heater a system for sensing these operational conditions and responsively terminating the firing of the water heater. It is to this goal that the present invention is directed.

SUMMARY OF THE INVENTION

In carrying out principles of the present invention, in accordance with a preferred embodiment thereof, fuel-fired heating apparatus is provided which is representatively in the form of a gas-fired water heater and includes a combustion chamber thermally communicatable with a fluid to be heated, and combustion apparatus operative to burn a fuel-air mixture within the combustion chamber. The combustion apparatus representatively includes a fuel burner structure disposed within the combustion chamber, a fuel valve for supplying fuel to the burner structure, and a flow path through which combustion air may be flowed into the combustion chamber.

Illustratively, the fuel valve is connected in an electrical circuit in series with a thermocouple portion of the burner structure. When the circuit is opened, the valve is precluded from supplying fuel to the burner structure.

In accordance with a key aspect of the present invention, a combustion shutoff system is provided which is operative to sense a temperature in the combustion chamber and responsively terminate further combustion therein in response to the temperature reaching a level correlated to and indicative of a predetermined, undesirably high concentration of carbon monoxide present in the combustion chamber. Representatively, but not by way of limitation, this level of carbon monoxide present within the combustion chamber is in the range of from about 200 ppm to about 400 ppm by volume.

In a first version of the combustion shutoff system, the combustion air temperature is directly sensed by a spring-loaded temperature sensing structure portion of the combustion shutoff system that projects into the interior of the combustion chamber. The temperature sensing structure, when exposed to the predetermined temperature level within the combustion chamber, responsively causes a damper external to the combustion chamber to close off the combustion air flow path and thereby terminate further combustion within the combustion chamber.

The temperature sensing structure, in various illustrative forms thereof, may include a eutectic element which is meltable to permit the damper to be spring-driven to its closed position, or a hollow, frangible, heat shatterable member, such as a glass bulb, containing a fluid such as mineral oil, peanut oil or an assembly lubricant.

In a second illustrative version of the combustion shutoff system, the temperature within the combustion chamber is also directly sensed using a spring-loaded temperature sensing structure, incorporating either a meltable eutectic member or a frangible, heat shatterable fluid-containing member, projecting into the interior of the combustion chamber. In this version of the combustion shutoff system, the spring-loaded temperature sensing structure is mechanically coupled to a normally closed switch structure connected in the fuel valve electrical circuit. When the spring-loaded temperature sensing structure is heat-triggered by the predetermined temperature within the combustion chamber, the temperature sensing structure responsively opens the switch, thereby opening the valve circuit and terminating further fuel flow to the burner structure. This, in turn, terminates further combustion within the combustion chamber.

In a third illustrative version of the combustion shutoff system, the temperature within the combustion chamber is indirectly sensed by a normally closed thermally actuated switch externally positioned on an outer wall portion of the combustion chamber, such outer wall portion representatively being an access door portion of the combustion chamber. The thermal switch is operatively connected in the fuel valve electrical circuit. When the predetermined combustion temperature level in the combustion chamber is reached, the heat generated thereby opens the thermal switch, thereby opening the fuel valve electrical circuit, terminating further fuel flow to the burner structure, and thus terminating further combustion within the combustion chamber.

BRIEF DESCRIPTION OF THE DRAWINGS

FIG. 5 is a perspective view of a specially designed bottom jacket pan which may be utilized in the water heater;

FIG. 6 is a side elevational view of the bottom jacket pan;

FIG. 7 is a cross-sectional view through the bottom jacket pan taken along line 7—7 of FIG. 6;

FIG. 8 is an enlargement of the circled area "8" in FIG. 7 and illustrates a portion of an annular, jacket edge-receiving support groove extending around the open top end of the bottom jacket pan;

FIG. 9 is a simplified partial cross-sectional view through a bottom end portion of a first alternate embodiment of the FIG. 1 water heater incorporating therein the bottom jacket pan shown in FIGS. 5–8;

DETAILED DESCRIPTION

Figure 1:
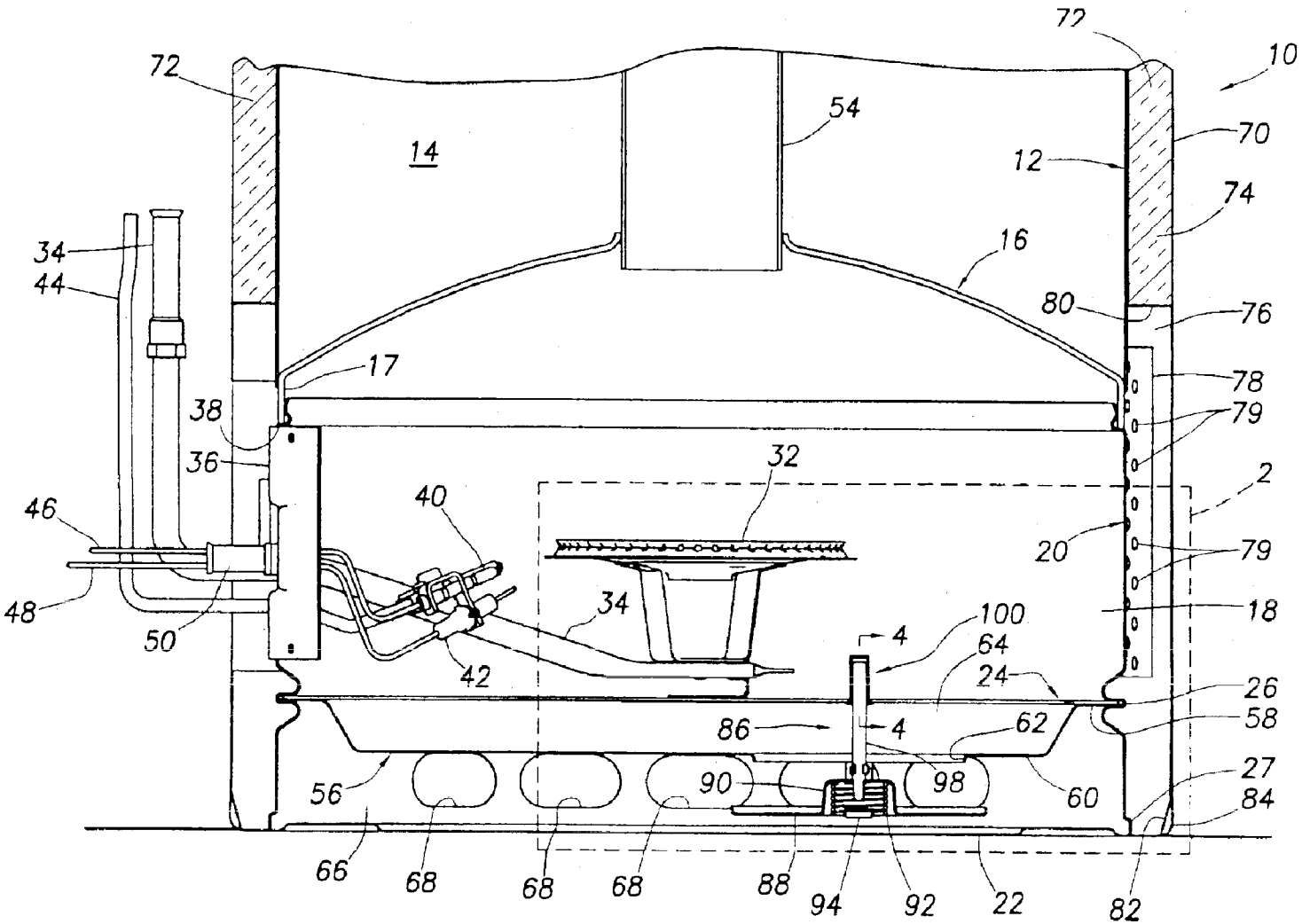
FIG. 1 is a simplified partial cross-sectional view through a bottom portion of a representative gas-fired water heater having incorporated therein a specially designed combustion air shutoff system embodying principles of the present invention.
Figure 2:
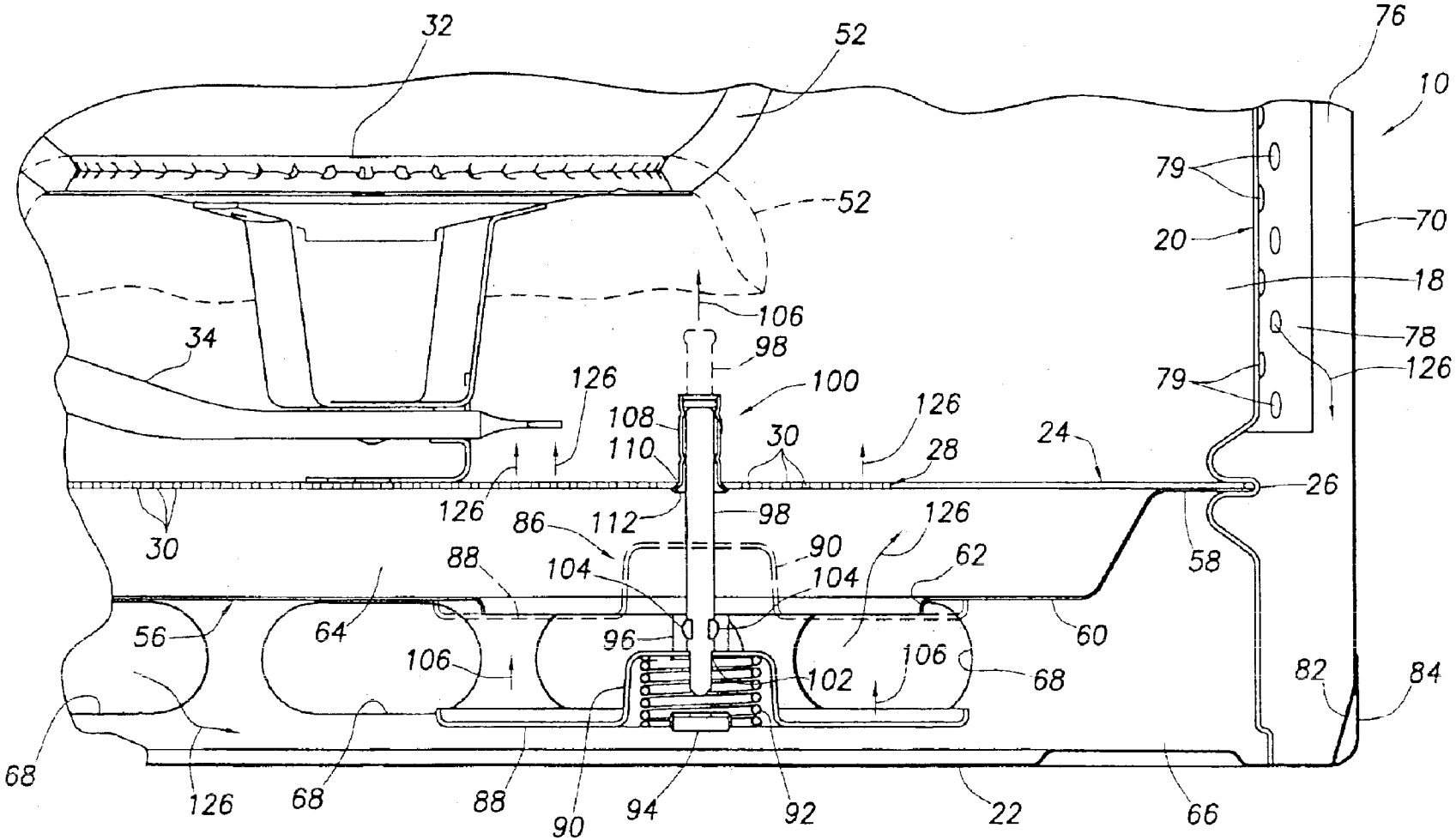
FIG. 2 is an enlargement of the dashed area "2" in FIG. 1 and illustrates the operation of a control damper portion of the combustion air shutoff system.

As illustrated in simplified, somewhat schematic form in FIGS. 1 and 2, in a representative embodiment thereof this invention provides a gas-fired water heater 10 having a vertically oriented cylindrical metal tank 12 adapted to hold a quantity of water 14 to be heated and delivered on demand to one or more hot water-using fixtures, such as sinks, bathtubs, showers, dishwashers and the like. An upwardly domed bottom head structure 16 having an open lower side portion 17 forms a lower end wall of the tank 12 and further defines the top wall of a combustion chamber 18 at the lower end of the tank 12. An annular metal skirt 20 extends downwardly from the periphery of the bottom head 16 to the lower end 22 of the water heater 10 and forms an annular outer side wall portion of the combustion chamber 18. An open upper end portion of the skirt 20 is press-fitted into the lower side portion 17 of the bottom head structure 16, and the closed lower end 27 of the skirt structure 20 downwardly extends to the bottom end 22 of the water heater 10.

Figure 3:
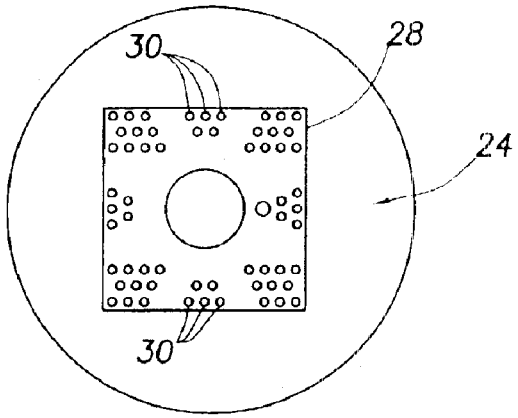
FIG. 3 is a simplified, reduced scale top plan view of an arrestor plate portion of the water heater that forms the bottom wall of its combustion chamber.

The bottom wall of the combustion chamber 18 is defined by a specially designed circular arrestor plate 24 having a peripheral edge portion received and captively retained in an annular roll-formed crimp area 26 of the skirt upwardly spaced apart from its lower end 27. AS best illustrated in FIG. 3, the circular arrestor plate 24 has a centrally disposed square perforated area 28 having formed therethrough a spaced series of flame arrestor or flame "quenching" openings 30 which are configured and arranged to permit combustion air and extraneous flammable vapors to flow upwardly into the combustion chamber 18, as later described herein, but substantially preclude the downward travel of combustion chamber flames therethrough. These arrestor plate openings 30 function similarly to the arrestor plate openings illustrated and described in U.S. Pat. No. 6,035,812 to Harrigill et al which is hereby incorporated herein by reference. Illustratively, the metal arrestor plate 24 is 1/16" thick, the arrestor plate openings 30 are 1/16" circular openings, and the center-to-center spacing of the openings 30 is 1/8".

A gas burner 32 is centrally disposed on a bottom interior side portion of the combustion chamber 18. Burner 32 is supplied with gas via a main gas supply pipe 34 (see FIG. 1) that extends into the interior of the combustion chamber 18 through a suitable access door 36 secured over an opening 38 formed in a subsequently described outer sidewall portion of the water heater 10. A conventional pilot burner 40 and associated piezo igniter structure 42 are suitably supported in the interior of the combustion chamber 18, with the pilot burner 40 being supplied with gas via a pilot supply pipe 44 extending inwardly through access door 36. Pilot burner and thermocouple electrical wires 46,48 extend inwardly through a pass-through tube 50 into the combustion chamber interior and are respectively connected to the pilot burner 40 and piezo igniter structure 42.

Burner 32 is operative to create within the combustion chamber 18 a generally upwardly directed flame 52 (as indicated in solid line form in FIG. 2) and resulting hot combustion products. During firing of the water heater 10, the hot combustion products flow upwardly through a flue structure 54 (see FIG. 1) that is connected at its lower end to the bottom head structure 16, communicates with the interior of the combustion chamber 18, and extends upwardly through a central portion of the tank 12. Heat from the upwardly traveling combustion products is transferred to the water 14 to heat it.

Extending beneath and parallel to the arrestor plate 24 is a horizontal damper pan 56 having a circular top side peripheral flange 58 and a bottom side wall 60 having an air inlet opening 62 disposed therein. Bottom side wall 60 is spaced upwardly apart from the bottom end 22 of the water heater 10, and the peripheral flange 58 is captives retained in the roll-crimped area 26 of the skirt 20 beneath the peripheral portion of the arrestor plate 24. The interior of the damper pan 56 defines with the arrestor plate 24 an air inlet plenum 64 that communicates with the combustion chamber 18 via the openings 30 in the arrestor plate 24. Disposed beneath the bottom pan wall 60 is another plenum 66 horizontally circumscribed by a lower end portion of the skirt 20 having a circumferentially spaced series of openings 68 therein.

The outer side periphery of the water heater 10 is defined by an annular metal jacket 70 which is spaced outwardly from the vertical side wall of the tank 12 and defines therewith an annular cavity 72 (see FIG. 1) which is filled with a suitable insulation material 74 down to a point 80 somewhat above the lower side of the bottom head 16. Beneath this point the cavity 72 has an empty portion 76 that extends outwardly around the skirt 20. A pre-filter screen area 78, having a series of air pre-filtering inlet openings 79 therein, is positioned in a lower end portion of the jacket 70, beneath the bottom end 80 of the insulation 74, and communicates the exterior of the water heater 10 with the empty cavity portion 76. Representatively, the screen area 78 is a structure separate from the jacket 70 and is removably secured in a corresponding opening therein. Illustratively, the pre-filter screen area 78 may be of an expanded metal mesh type formed of 3/16" carbon steel in a #22F diamond opening pattern having approximately 55% open area, or could be a metal panel structure having perforations separately formed therein. Alternatively, the openings 79 may be formed directly in the jacket 70. AS illustrated in FIGS. 1 and 2, a lower end portion 82 of the jacket 70 is received within a shallow metal bottom pan structure 84 that defines, with its bottom side, the bottom end 22 of the water heater 10.

Water heater 10 incorporates therein a specially designed combustion air shutoff system 86 which, under certain circumstances later described herein, automatically functions to terminate combustion air supply to the combustion chamber 18 via a flow path extending inwardly from the jacket openings 79 to the arrestor plate openings 30. The combustion air shutoff system 86 includes a circular damper plate member 88 that is disposed in the plenum 66 beneath the bottom pan wall opening 62 and has a raised central portion 90. A coiled spring member 92 is disposed within the interior of the raised central portion 90 and is compressed between its upper end and the bottom end 94 of a bracket 96 (see FIG. 2) secured at its top end to the underside of the bottom pan wall 60.

The lower end of a solid cylindrical metal rod portion 98 of a fusible link temperature sensing structure 100 extends downwardly into the raised portion 90, through a suitable opening in its upper end. An annular lower end ledge 102 (see FIG. 2) on the rod 98 prevents the balance of the rod 98 from moving downwardly into the interior of the raised damper member portion 90. Just above the ledge 102 (see FIG. 2) are diametrically opposite, radially outwardly extending projections 104 formed on the rod 98. During normal operation of the water heater 10, the damper plate member 88 is held in its solid line position by the rod 98, as shown in FIG. 2, in which the damper plate 88 is downwardly offset from and uncovers the bottom pan wall opening 62, with the spring 92 resiliently biasing the damper plate member 88 upwardly toward the bottom pan wall opening 62. When the fusible link temperature sensing structure 100 is thermally tripped, as later described herein, it permits the spring 92 to upwardly drive the damper plate member 88 to its dotted line closed position (see FIG. 2), as indicated by the arrows 106 in FIG. 2, in which the damper plate member 88 engages the bottom pan wall 60 and closes off the opening 62 therein, thereby terminating further air flow into the combustion chamber 18 as later described herein.

Figure 4:
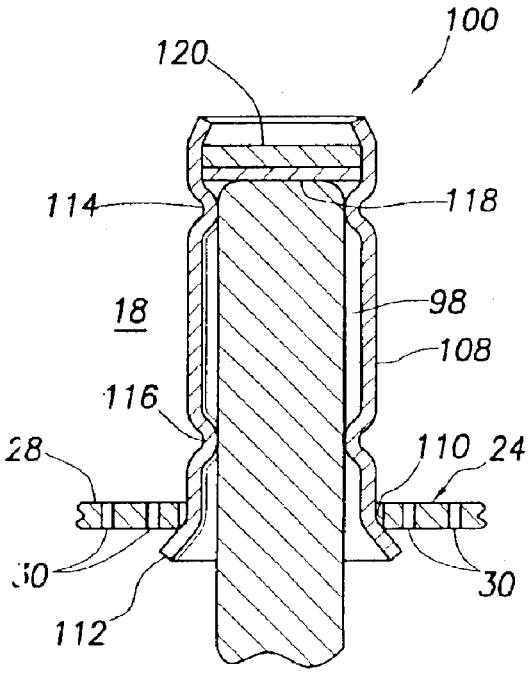
FIG. 4 is an enlarged scale cross-sectional view, taken along line 4—4 of FIG. 1, through a specially designed eutectic temperature sensing structure incorporated in the combustion air shutoff system and projecting into the combustion chamber of the water heater.

Turning now to FIGS. 2 and 4, it can be seen that the temperature sensing structure 100 projects upwardly into the combustion chamber 18 through the perforated square central area 28 of the arrestor plate 24. An upper end portion of the rod 98 is slidably received in a crimped tubular collar member 108 that longitudinally extends upwardly through an opening 110 in the central square perforated portion 28 of the arrestor plate 24 into the interior of the combustion chamber 18, preferably horizontally adjacent a peripheral portion of the gas burner 32. The lower end of the tubular collar 108 is outwardly flared, as at 112, to keep the collar 108 from moving from its FIG. 2 position into the interior of the combustion chamber 18. Above its flared lower end portion 112 the collar has two radially inwardly projecting annular crimps formed therein—an upper crimp 114 adjacent the open upper end of the collar, and a lower crimp 116 adjacent the open lower end of the collar. These crimps serve to guide the rod 98 within the collar 108 to keep the rod from binding therein when it is spring-driven upwardly through the collar 108 as later described herein.

A thin metal disc member 118, having a diameter somewhat greater than the outer diameter of the rod and greater than the inner diameter of the upper annular crimp 114, is slidably received within the open upper end of the collar 108, just above the upper crimp 114, and underlies a meltable disc 120, formed from a suitable eutectic material, which is received in the open upper end of the collar 108 and fused to its interior side surface. The force of the damper spring 92 (see FIG. 2) causes the upper end of the rod 98 to forcibly bear upwardly against the underside of the disc 118, with the unmelted eutectic disc 120 preventing upward movement of the disc 118 away from its FIG. 4 position within the collar 108. When the eutectic disc 120 is melted, as later described herein, the upper end of the rod 98, and the disc 118, are driven by the spring 92 upwardly through the upper end of the collar 108 (as indicated by the dotted line position of the rod 98 shown in FIG. 2) as the damper plate 88 is also spring-driven upwardly to its dotted line closed position shown in FIG. 2.

Figure 4A:
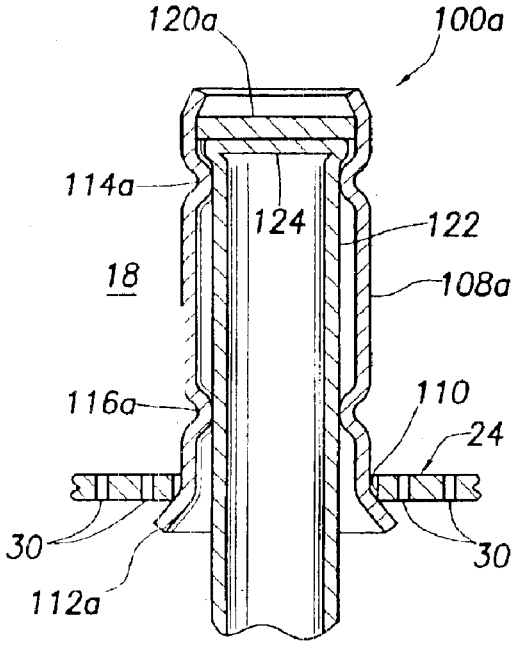
FIG. 4A is a cross-sectional view through a first alternate embodiment of the eutectic temperature sensing structure shown in FIG. 4.

A first alternate embodiment 100*a* of the eutectic temperature sensing structure 100 partially illustrated in FIG. 4 is shown in FIG. 4A. For ease in comparison between the temperature sensing structures 100,100*a* components in the temperature sensing structure 100*a* similar to those in the temperature sensing structure 100 have been given identical reference numerals with the subscript "a". The eutectic temperature sensing structure 100*a* is substantially identical in operation to the temperature sensing structure 100, but is structurally different in that in the temperature sensing structure 100*a* the solid metal rod 98 is replaced with a hollow tubular metal rod 122, and the separate metal disc 118 is replaced with a laterally enlarged, integral crimped circular upper end portion 124 of the hollow rod 122 that underlies and forcibly bears upwardly against the underside of the eutectic disc 120*a*.

During firing of the water heater 10, ambient combustion air 126 (see FIG. 2) is sequentially drawn inwardly through the openings 79 in the jacket-disposed pre-filter screen area 78 into the empty cavity portion 76, into the plenum 66 via the skirt openings 68, upwardly through the bottom pan wall opening 62 into the plenum 64, and into the combustion chamber 18 via the arrestor plate openings 30 to serve as combustion air for the burner 32.

In the water heater 10, the combustion air shutoff system 86 serves two functions during firing of the water heater. First, in the event that extraneous flammable vapors are drawn into the combustion chamber 18 and begin to burn on the top side of the arrestor plate 24, the temperature in the combustion chamber 18 will rise to a level at which the combustion chamber heat melts the eutectic disc 120 (or the eutectic disc 120*a* as the case may be), thereby permitting the compressed spring 92 to upwardly drive the rod 98 (or the rod 122 as the case may be) through the associated collar 108 or 108*a* until the damper plate member 88 reaches its dashed line closed position shown in FIG. 2 in which the damper plate member 88 closes the bottom pan wall opening 62 and terminates further combustion air delivery to the burner 32 via the combustion air flow path extending from the pre-filter openings 79 to the arrestor plate openings 30. Such termination of combustion air delivery to the combustion chamber shuts down the main and pilot gas burners 32 and 40. AS the rod 98 is spring-driven upwardly after the eutectic disc 120 melts (see the dotted line position of the rod 98 in FIG. 2), the lower end projections 104 on the rod 98 prevent it from being shot upwardly through and out of the collar 108 into the combustion chamber 18. Similar projections formed on the alternate hollow rod 122 perform this same function.

The specially designed combustion air shutoff system 86 also serves to terminate burner operation when the eutectic disc 120 (or 120*a*) is exposed to and melted by an elevated combustion chamber temperature indicative of the generation within the combustion chamber 18 of an undesirably high concentration of carbon monoxide created by clogging of the pre-filter screen structure 78 and/or the arrestor plate openings 30. Preferably, the collar portion 108 of the temperature sensing structure 100 is positioned horizontally adjacent a peripheral portion of the main burner 32 (see FIG. 2) so that the burner flame "droop" (see the dotted line position of the main burner flame 52) created by such clogging more quickly melts the eutectic disc 120 (or the eutectic disc 120*a* as the case may be).

Figure 10:
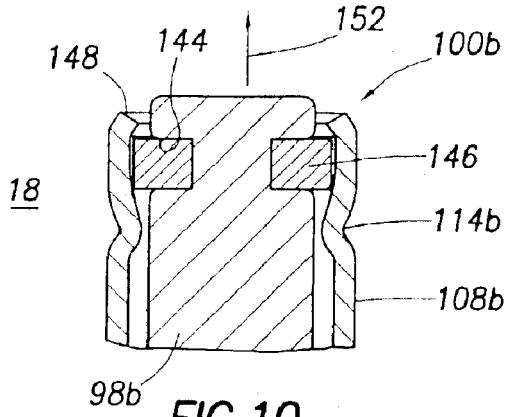
FIG. 10 is a cross-sectional view through an upper end portion of a second alternate embodiment of the eutectic temperature sensing structure shown in FIG. 4.

An upper end portion of a second alternate embodiment 100*b* of the previously described eutectic temperature sensing structure 100 (see FIG. 4) is cross-sectionally illustrated in FIG. 10. For ease in comparison between the temperature sensing structures 100,100*b* components in the temperature sensing structure 100*b* similar to those in the temperature sensing structure 100 have been given identical reference numerals with the subscript "b". The eutectic temperature sensing structure 100*b* is substantially identical in operation to the temperature sensing structure 100, but is structurally different in that in the temperature sensing structure 100*b* the metal rod 98*b* has an annular groove 144 formed in its upper end and receiving an inner edge portion of an annular eutectic alloy member 146.

As illustrated in FIG. 10, an outer annular peripheral edge portion of the eutectic member 146 projects outwardly beyond the side of the rod 98*b* and underlies an annular crimp 148 formed on the upper end of the tubular collar member 108*b*. Crimp 148 overlies and upwardly blocks the outwardly projecting annular edge portion of the eutectic member 146, thereby precluding the rod 98*b* from being spring-driven upwardly past its FIG. 10 position relative to the collar member 108*b*. However, when the eutectic member 146 is melted it no longer precludes such upward movement of the rod 98*b*, and the rod 98*b* is spring-driven upwardly relative to the collar 108*b* as illustrated by the arrow 152 in FIG. 10.

Figure 11:
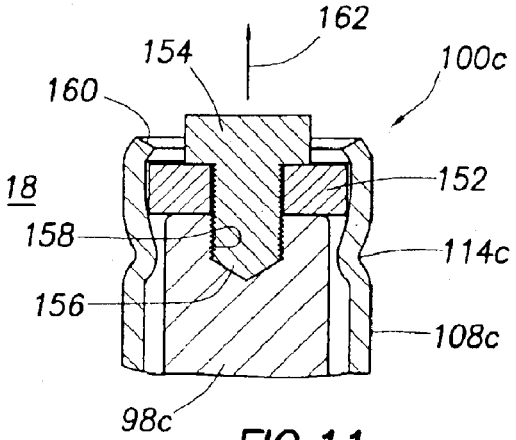
FIG. 11 is a cross-sectional view through an upper end portion of a third alternate embodiment of the eutectic temperature sensing structure shown in FIG. 4.

An upper end portion of a third alternate embodiment 100*c* of the previously described eutectic temperature sensing structure 100 (see FIG. 4) is cross-sectionally illustrated in FIG. 11. For ease in comparison between the temperature sensing structures 100,100*c* components in the temperature sensing structure 100*c* similar to those in the temperature sensing structure 100 have been given identical reference numerals with the subscript "c". The eutectic temperature sensing structure 100*c* is substantially identical in operation to the temperature sensing structure 100, but is structurally different in that in the temperature sensing structure 100*c* an annular eutectic alloy member 152 is captively retained between the upper end of the rod 98*c* and the enlarged head portion 154 of a threaded retaining member 156 extended downwardly through the center of the eutectic member 152 and threaded into a suitable opening 158 formed in the upper end of the rod 98*c*.

AS illustrated in FIG. 11, an annularly crimped upper end portion 160 of the tubular collar 108*c* upwardly overlies and blocks an annular outer peripheral portion of the eutectic member 152, thereby precluding upward movement of the rod 98*c* and the fastener 156 upwardly beyond their FIG. 11 positions relative to the collar 108*c*. However, when the eutectic member 152 is melted the rod 98*c* and fastener 156 are free to be spring-driven upwardly relative to the collar 108*c* as indicated by the arrow 162 in FIG. 11.

Figure 12:
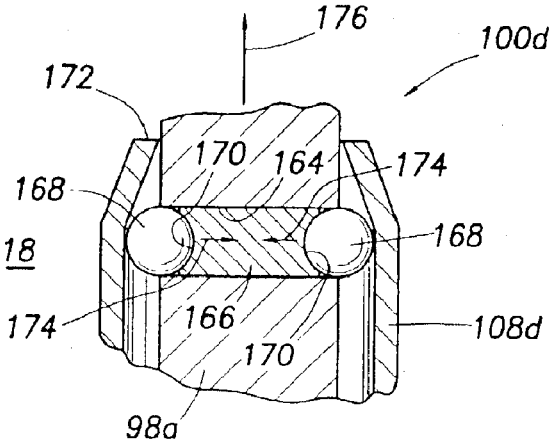
FIG. 12 is a cross-sectional view through an upper end portion of a fourth alternate embodiment of the eutectic temperature sensing structure shown in FIG. 4.
Figure 14:
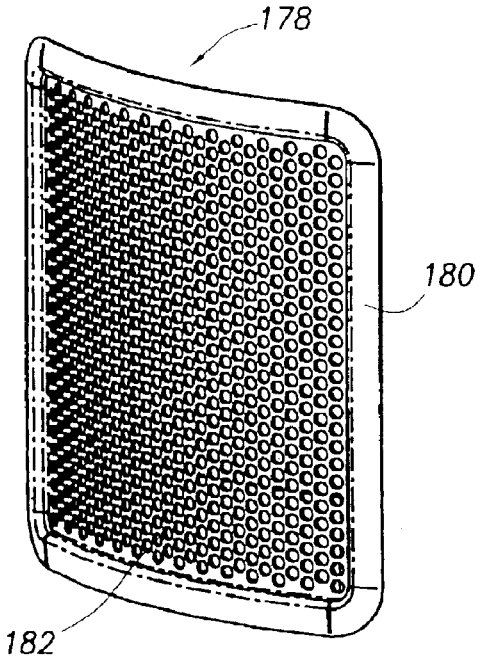
FIG. 14 is an enlarged scale outer side perspective view of a molded plastic snap-in combustion air pre-filter structure incorporated in the FIG. 13 water heater.

An upper end portion of a fourth alternate embodiment 100*d* of the previously described eutectic temperature sensing structure 100 (see FIG. 4) is cross-sectionally illustrated in FIG. 12. For ease in comparison between the temperature sensing structures 100,100*d* components in the temperature sensing structure 100*dc* similar to those in the temperature sensing structure 100 have been given identical reference numerals with the subscript "d". The eutectic temperature sensing structure 100*dc* is substantially identical in operation to the temperature sensing structure 100, but is structurally different in that a transverse circular bore 164 is formed through the rod 98*d* adjacent its upper end, the bore 164 complementarily receiving a cylindrical eutectic alloy member 166.

A pair of metal balls 168, each sized to move through the interior of the bore 164, partially extend into the opposite ends of the bore 164 and are received in partially spherical indentations 170 formed in the opposite ends of the eutectic member 166. An annular crimped upper end portion 172 of the collar 108*d* upwardly overlies and blocks the portions of the balls 168 that project outwardly beyond the side of the rod 98*a*, thereby precluding upward movement of the rod 98*d* from its FIG. 12 position relative to the collar 108*d*. However, when the eutectic member 166 is melted, the upward spring force on the rod 98*d* causes the crimped area 172 to force the balls 168 toward one another through the bore 164, as indicated by the arrows 174 in FIG. 12, thereby permitting the rod 98*d* to be upwardly driven from its FIG. 12 position relative to the collar 108*d* as illustrated by the arrow 176 in FIG. 12.

According to another feature of the present invention, (1) the opening area-to-total area ratios of the pre-filter screen structure 78 and the arrestor plate 24, (2) the ratio of the total open area in the pre-filter screen structure 78 to the total open area in the arrestor plate 24, and (3) the melting point of the eutectic material 120 (or 120*a*,146,152 or 166 as the case may be) are correlated in a manner such that the rising combustion temperature in the combustion chamber 18 caused by a progressively greater clogging of the pre-filter openings 79 and the arrestor plate openings 30 (by, for example, airborne material such as lint) melts the eutectic material 120 and trips the temperature sensing structure 100 and corresponding air shutoff damper closure before a predetermined maximum carbon monoxide concentration level (representatively about 200–400 ppm by volume) is reached within the combustion chamber 18 due to a reduced flow of combustion air into the combustion chamber. The pre-filter area 78 and the array of arrestor plate openings 30 are also sized so that some particulate matter is allowed to pass through the pre-filter area and come to rest on the arrestor plate. This relative sizing assures that combustion air will normally flow inwardly through the pre-filter area as opposed to being blocked by particulate matter trapped only by the pre-filter area.

In developing the present invention it has been found that a preferred "matching" of the pre-filter structure to the perforated arrestor plate area, which facilitates the burner shutoff before an undesirable concentration of CO is generated within the combustion chamber 18 is during firing of the burner 32, is achieved when (1) the ratio of the open area-to-total area percentage of the pre-filter structure 78 to the open area-to-total area percentage of the arrestor plate 24 is within the range of from about 1.2 to about 2.5, and (2) the ratio of the total open area of the pre-filter structure 78 to the total open area of the arrestor plate 24 is within the range of from about 2.5 to about 5.3. The melting point of the eutectic portion of the temperature sensing structure 100 may, of course, be appropriately correlated to the determinable relationship in a given water heater among the operational combustion chamber temperature, the quantity of combustion air being flowed into the combustion chamber, and the ppm concentration level of carbon monoxide being generated within the combustion chamber during firing of the burner 32.

By way of illustration and example only, the water heater 10 illustrated in FIGS. 1 and 2 representatively has a tank capacity of 50 gallons of water; an arrestor plate diameter of 20 inches; and a burner firing rate of between 40,000 and 45,000 BTUH. The total area of the square perforated arrestor plate section 28 (see FIG. 3) is 118.4 square inches, and the actual flow area defined by the perforations 30 in the square area 28 is 26.8 square inches. The overall area of the jacket pre-filter structure 78 is 234 square inches, and the actual flow area defined by the openings in the structure 78 is 119.4 square inches. The ratio of the hydraulic diameter of the arrestor openings 30 to the thickness of the arrestor plate 24 is within the range of from about 0.75 to about 1.25, and is preferably about 1.0, and the melting point of the eutectic material in the temperature sensing structure 100 is within the range of from about 425 degrees F. to about 465 degrees F., and is preferably about 430 degrees F.

Cross-sectionally illustrated in simplified form in FIG. 9, is a bottom side portion of a first alternate embodiment 10*a* of the previously described gas-fired water heater 10. For ease in comparing the water heater embodiments 10 and 10*a*, components in the embodiment 10*a* similar to those in the embodiment 10 have been given the same reference numerals, but with the subscripts "a".

The water heater 10*a* is identical to the previously described water heater 10 with the exceptions that in the water heater 10*a* (1) the pre-filter screen area 78 carried by the jacket 70 in the water heater 10 is eliminated and replaced by a subsequently described structure, (2) the lower end 82*a* of the jacket 70*a* is disposed just below the bottom end 80*a* of the insulation 74*a* instead of extending clear down to the bottom end 22*a* of the water heater 10*a*, and (3) the shallow bottom pan 84 utilized in the water heater 10 is replaced in the water heater 10*a* with a considerably deeper bottom jacket pan 128 which is illustrated in FIGS. 5–8.

Bottom jacket pan 128 is representatively of a one piece molded plastic construction (but could be of a different material and/or construction if desired) and has an annular vertical sidewall portion 130, a solid circular bottom wall 132, and an open upper end bordered by an upwardly opening annular groove 134 (see FIGS. 8 and 9). Formed in the sidewall portion 130 are (1) a bottom drain fitting 136, (2) a burner access opening 138 (which takes the place of the access opening 38 in the water heater 10), (3) a series of pre-filter air inlet openings 140 (which take the place of the pre-filter openings 79 in the water heater 10), and (4) a holder structure 142 for a depressible button portion (not shown) of a piezo igniter structure associated with the main burner portion of the water heater 10*a*.

AS best illustrated in FIG. 9, the annular skirt 20*a* extends downwardly through the interior of the pan 128, with the bottom skirt end 27*a* resting on the bottom pan wall 132, and the now much higher annular lower end 82*a* of the jacket 70*a* being closely received in the annular groove 134 extending around the top end of the pan structure 128. The use of this specially designed one piece bottom jacket pan 128 desirably reduces the overall cost of the water heater 10*a* and simplifies its construction.

Figure 13:
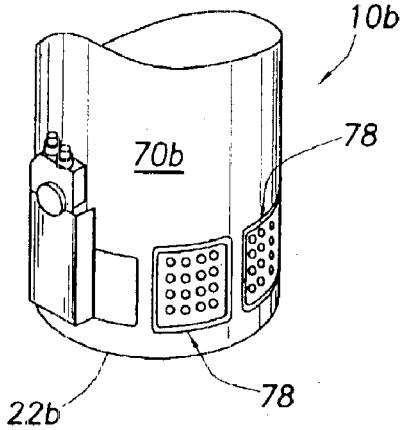
FIG. 13 is a simplified perspective view of a bottom end portion of a second embodiment of the FIG. 1 water heater.

Perspectively illustrated in simplified form in FIG. 13 is a bottom end portion of a second alternate embodiment 10*b* of the previously described gas-fired water heater 10. For ease in comparing the water heater embodiments 10 and 10*b*, components in the embodiment 10*b* similar to those in the embodiment 10 have been given the same reference numerals, but with the subscripts "b".

The water heater 10*b* is identical to the previously described water heater 10 with the exception that in the water heater 10*b* the previously described pre-filter screen area 78 carried by the jacket 70 in the water heater 10 (see FIGS. 1 and 2) is eliminated and replaced by a circumferentially spaced series of specially designed, molded plastic perforated pre-filtering panels 178 which are removably snapped into corresponding openings in a lower end portion of the outer jacket structure 70*b* of the water heater 10*b*.

Figure 15:
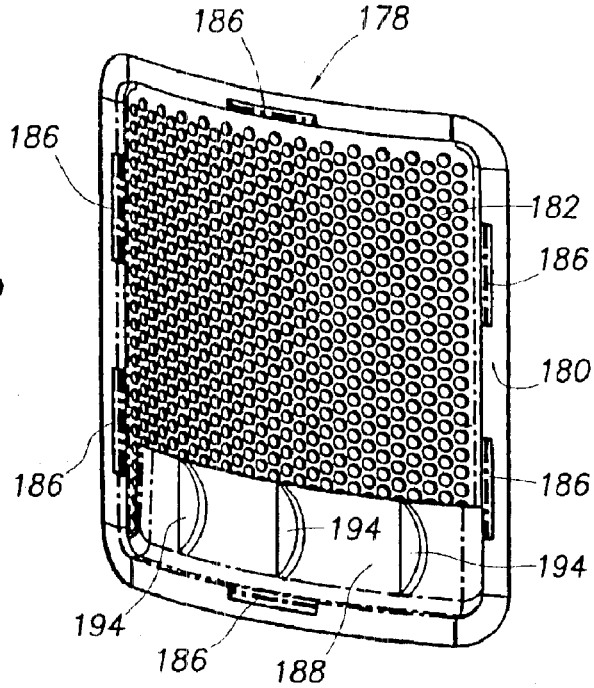
FIG. 15 is an inner side perspective view of the molded plastic pre-filter structure.
Figure 16:
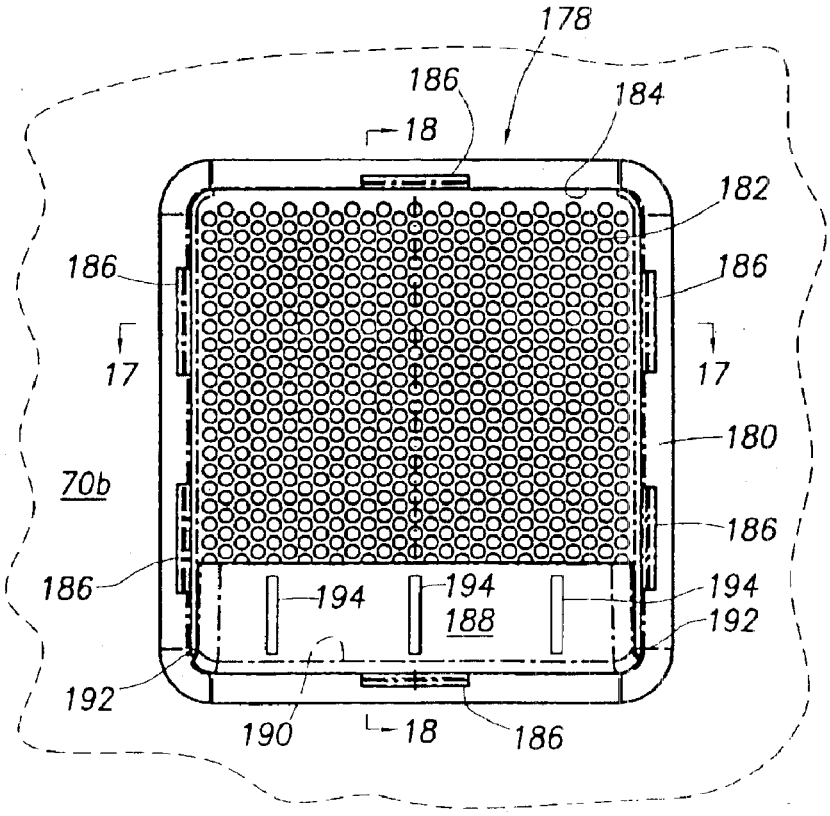
FIG. 16 is an inner side elevational view of the molded plastic pre-filter structure operatively installed in the FIG. 13 water heater.
Figure 17:
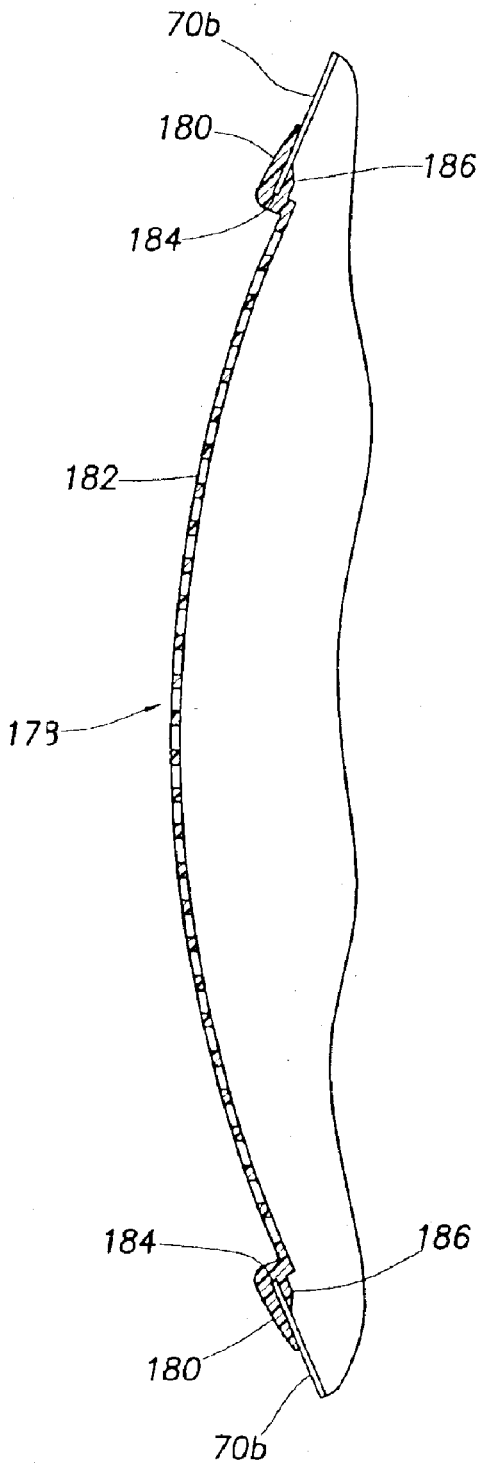
FIG. 17 is an enlarged cross-sectional view through the molded plastic pre-filter structure taken along line 17—17 of FIG. 16.
Figure 18:
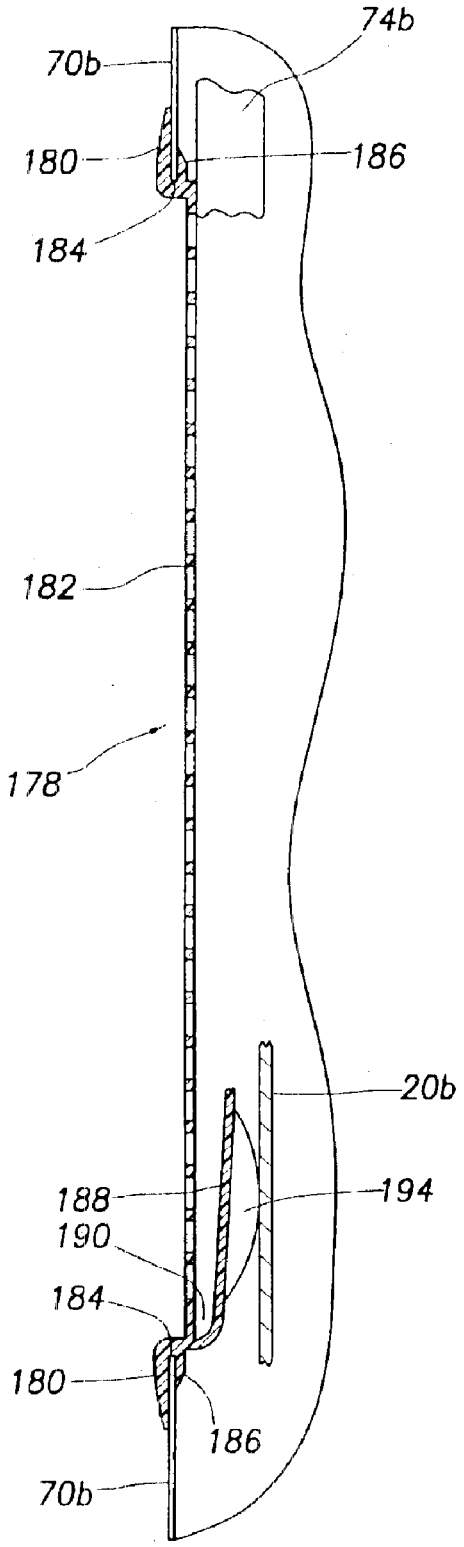
FIG. 18 is an enlarged cross-sectional view through the molded plastic pre-filter structure taken along line 18—18 of FIG. 16.

With reference now to FIGS. 14–18, each of the molded plastic perforated pre-filter panels 178 has a rectangular frame 180 that borders a rectangular, horizontally curved perforated air pre-filtering plate 182. Each panel 178 may be removably snapped into a corresponding rectangular opening 184 (see FIGS. 16–18) using resiliently deflectable retaining tabs 186 formed on the inner side of the frame 180 and adapter to inwardly overlie the jacket 70*b* at spaced locations around the periphery of the jacket opening 184 as shown in FIGS. 16–18.

Formed on a bottom end portion of the inner side of each frame 180 is an upstanding shield plate 188 which is inwardly spaced apart from the frame 180 and forms with a bottom side portion thereof a horizontally extending trough 190 (see FIGS. 16 and 18) having opposite open ends 192 (see FIGS. 15 and 16). AS illustrated in FIGS. 15, 16 and 18, a horizontally spaced plurality of reinforcing tabs 194 project outwardly from the inner side of the shield plate 188.

As illustrated in FIG. 18, a top end portion of each installed pre-filter panel 178 contacts an inwardly adjacent portion of the overall insulation structure 74*b*, thereby bracing a portion of the jacket 70*b* against undesirable inward deflection adjacent the upper end of opening 184. At the bottom end of each installed pre-filter panel 178, the arcuate outer side edges of the reinforcing tabs 194 are normally spaced slightly outwardly from the skirt structure 20*b*. However, if a bottom end portion of the panel 178 and an adjacent portion of the jacket 70*b* are deflected inwardly toward the skirt structure 20*b*, the tabs 194 (as shown in FIG. 18) are brought to bear against the skirt structure 20*b* and serve to brace and reinforce the adjacent portion of the jacket 70*b* against further inward deflection thereof.

The shield plate portion 188 of each pre-filter panel 178 uniquely functions to prevent liquid splashed against a lower outer side portion of the installed panel 178 from simply traveling through the plate perforations and coming into contact with the skirt 20*b* and the air inlet openings therein. Instead, such splashed liquid comes into contact with the outer side of the shield plate 188, drains downwardly therealong into the trough 190, and spills out of the open trough ends 192 without coming into contact with the skirt 194.

Figure 19:
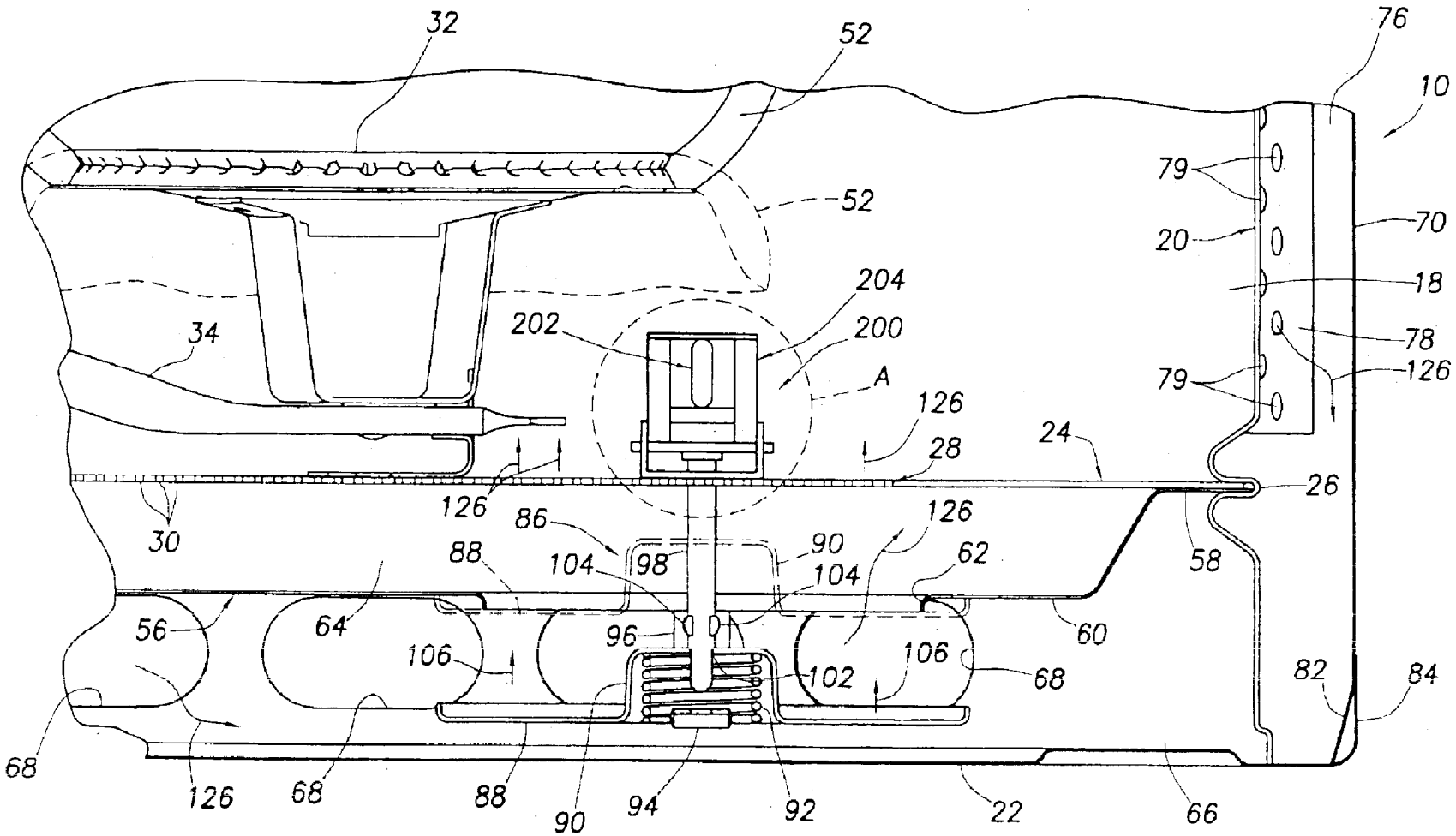
FIG. 19 is a view similar to that in FIG. 2 but illustrating a heat-frangible temperature sensing structure in place of the eutectic-based temperature sensing structure shown in FIG. 2.

Cross-sectionally illustrated in FIG. 19 is a bottom portion of the water heater 10 in which the previously described eutectic-based temperature sensing structure 100 (see FIGS. 1 and 2) has been replaced with a specially designed heat frangible temperature sensing structure 200, further details of which are shown in FIGS. 20–25. AS later described herein, the temperature sensing structure 200 includes a heat frangible element 202 which is positioned above the upper end of the rod 98 and serves to block its upward movement from its solid line position in FIG. 19 to its dotted line position, thereby blockingly retaining the shutoff damper 88 in its solid line open position shown in FIG. 19.

Figure 20:
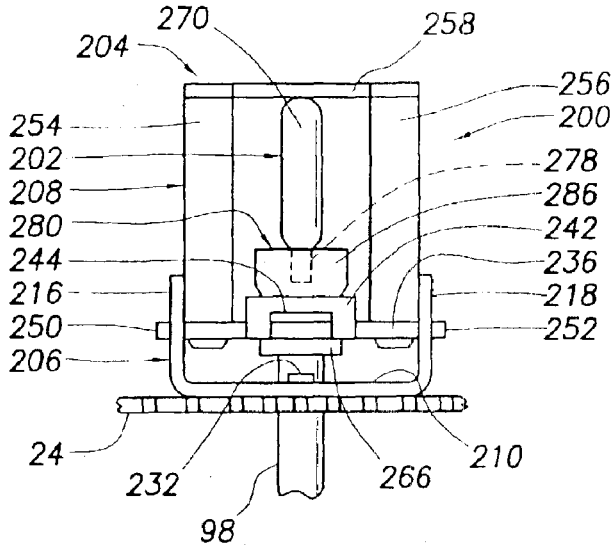
FIG. 20 is an enlargement of the dashed area "A" in FIG. 19 and illustrates an upper portion of the heat-frangible temperature sensing structure in a pre-activation orientation.

With reference now to FIGS. 19 and 20, the frangible element 202 is disposed in the interior of the combustion chamber 18 and is carried in a frame structure 204 which is secured as later described to the top side of arrestor plate 24 adjacent the gas burner 32. The rod 98 slidably extends upwardly through a hole (not shown) in the arrestor plate 24, with the upper end of the rod being associated with the balance of the temperature sensing structure 200 as also later described herein.

Figure 24:
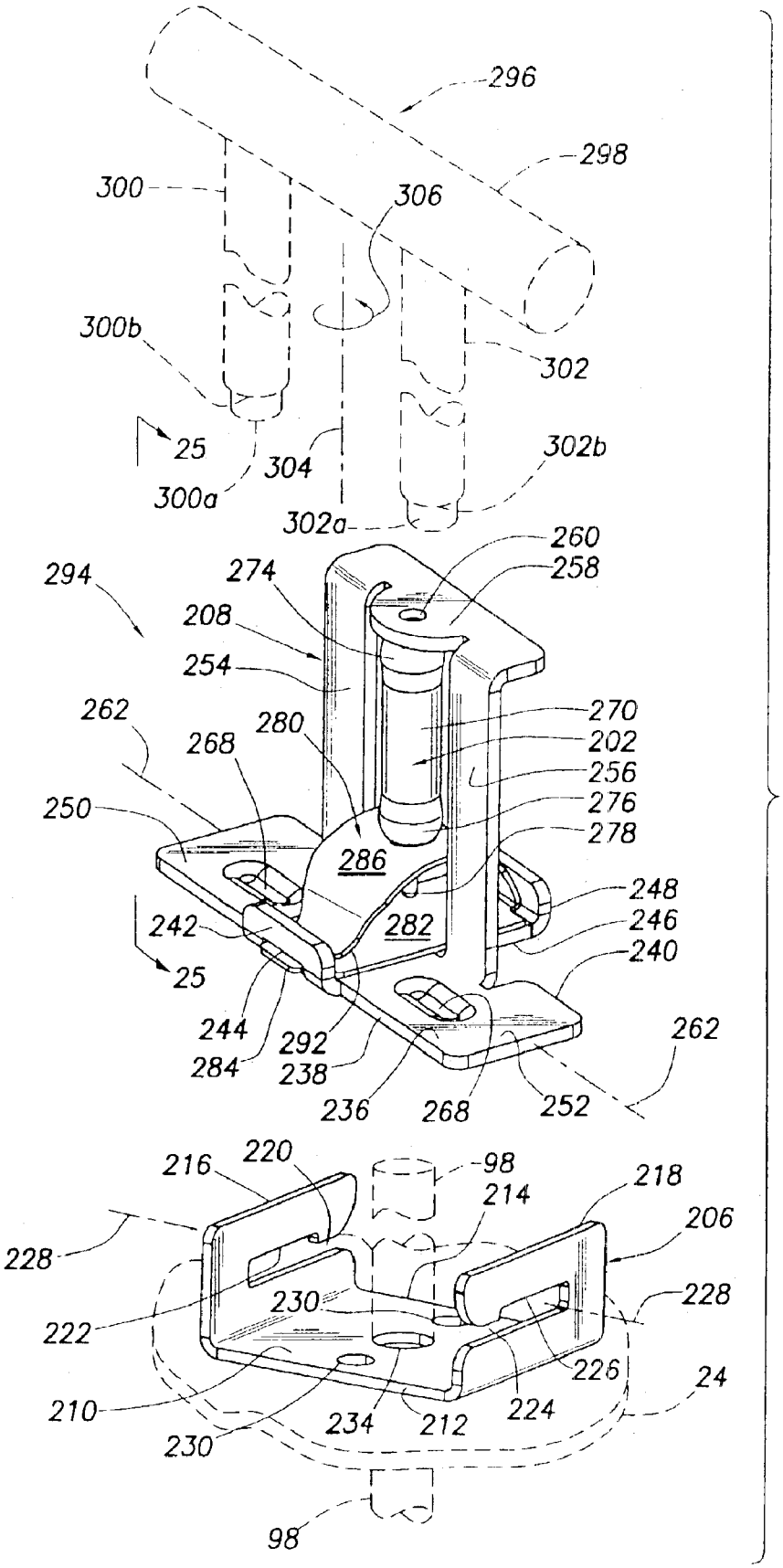
FIG. 24 is an enlarged scale partially exploded perspective view of an upper end portion of the heat-frangible temperature sensing structure illustrating its installation on the combustion chamber arrestor plate of a gas-fired water heater.

Turning now to FIGS. 20–25, the frame structure 204 includes two primary parts—a base portion 206 and a support portion 208. The base portion 206 (see FIG. 24) has an elongated rectangular base or bottom wall 210 with front and rear side edges 212,214 and upturned left and right end tabs 216,218. A slot 220 horizontally extends forwardly through the rear edge of the left end tab 216 and has a vertically enlarged front end portion 222, and a slot 224 horizontally extends rearwardly through the front edge of the right end tab 218 and has a vertically enlarged rear end portion 226. As shown in FIG. 24, the end tabs 216,218 are in a facing relationship with one another, and are spaced apart along an axis 228.

A pair of circular mounting holes 230 extend through the bottom wall 210, with screws 232 or other suitable fastening members (see FIG. 20) extending downwardly through holes 230 and anchoring the bottom wall 210 to the top side of the arrestor plate 24. A somewhat larger diameter circular hole 234 extends through the bottom wall 210 between the holes 230. AS shown in phantom in FIG. 24, the rod 98 extends upwardly through the corresponding hole (not visible) in the arrestor plate 24, and hole 234 that overlies the arrestor plate hole. In FIG. 24, the rod 98 is illustratively shown it its uppermost position (corresponding to the dotted line closed position of the damper 88 shown in FIG. 19) in which the top end of the rod 98 is positioned higher than the tab slots 220 and 224.

With reference now to FIGS. 20, 22, 24 and 25, the frame support portion 208 has an elongated rectangular horizontal bottom wall 236 with opposite front and rear side edges 238,240. A central front tab 242 having a rectangular slot 244 extending therethrough projects upwardly from the front side edge 238 across from an elongated central rear tab 246 that rearwardly projects past the rear side edge 240 of the bottom wall 236 and has an upturned outer end 248. Just inwardly of opposite left and right end portions 250,252 of the bottom wall 236 are horizontally spaced elongated rectangular bars 254,256 that longitudinally extend upwardly from adjacent the rear side edge of the bottom wall 236, on opposite sides of the rear tab 246, and are joined at their top ends by a horizontal top wall 258 having a circular hole 260 centrally disposed therein.

The opposite end portions 250,252 of the bottom wall 236 are spaced apart along an axis 262. A central circular opening 264 (see FIG. 22) extends downwardly through the bottom wall 236 and is bordered by a depending annular collar 266 (see FIG. 25). The opening 264 and collar 266 are sized to slidably receive the rod 98 as later described herein. The central opening 264 is disposed between two installation openings 268 extending downwardly through the bottom wall 236.

Figure 21:
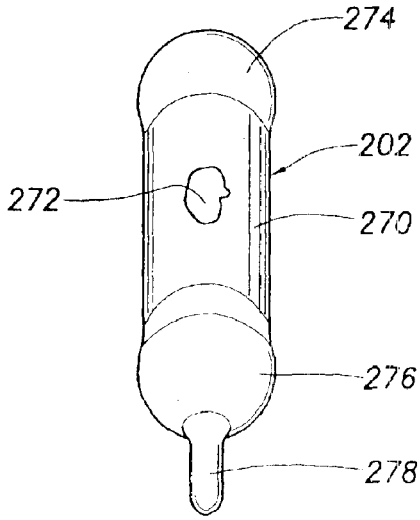
FIG. 21 is an enlarged scale perspective view of a fluid-filled glass bulb portion of the heat-frangible temperature sensing structure.
Figure 22:
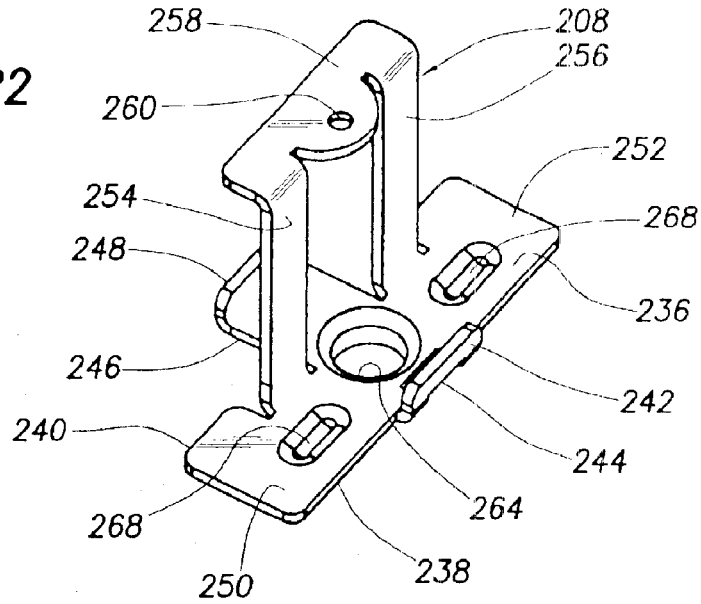
FIG. 22 is an enlarged scale perspective view of a support frame portion of the heat-frangible temperature sensing structure.
Figure 23:
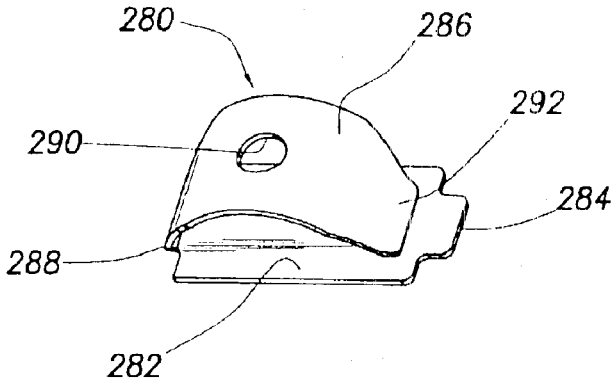
FIG. 23 is an enlarged scale perspective view of a spring portion of the heat-frangible temperature sensing structure.
Figure 25:
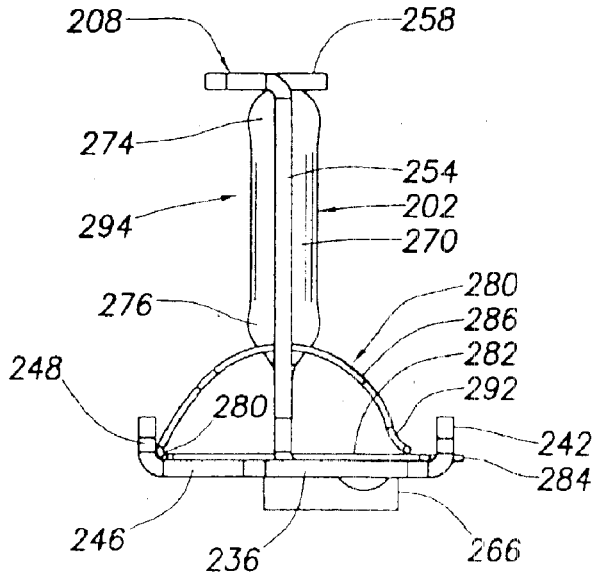
FIG. 25 is a side elevational view of a portion of the heat-frangible temperature sensing structure taken along line 25—25 of FIG. 24.

With reference now to FIG. 21, the frangible element 202 has a hollow body portion in the form of a generally tubular glass bulb 270 which is filled with a fluid, representatively peanut oil 272, which has a boiling point higher than the set point temperature of the temperature sensing structure 200 (representatively the same set point temperature of the previously described eutectic-based temperature sensing structure 100) and a flash point temperature substantially above the predetermined set point temperature. Other suitable fluids include, by way of example and not in a limiting manner, mineral oil or a suitable assembly lubricant such as Proeco 46 assembly lubricant as manufactured and sold by Cognis Corporation, 8150 Holton Drive, Florence, Ky. 41042.

The frangible element 202 is constructed in a manner causing it to shatter in response to exposure to the set point temperature within the combustion chamber 18. Illustratively, the peanut oil 272 is placed in the bulb 270 (before the sealing off of the bulb) in an assembly environment at a temperature slightly below the set point temperature of the temperature sensing structure 200. Bulb 270 is then suitably sealed, and the frangible element 202 is permitted to come to room temperature for subsequent incorporation in the temperature sensing structure 200. Representatively, the bulb 270 has generally spherical upper and lower end portions 274,276 and a substantially smaller diameter tubular portion 278 projecting axially downwardly from its lower end portion 276.

In addition to the previously described rod, frangible element and frame portions 98, 202 and 204 of the temperature sensing structure 200, the temperature sensing structure 200 further includes a small sheet metal spring member 280 (see FIGS. 20 and 23–25). Spring member 280 has a generally rectangular bottom wall 282 with a front end tab 284, and a downwardly curved top wall 286 which is joined at area 288 to the rear edge of the bottom wall 282 and overlies the top side of the bottom wall 282. Top wall 286 has a central circular hole 290 therein, and a front end edge portion 292 which is closely adjacent a portion of the top side of the bottom wall 282 inwardly adjacent the tab 284.

With the rod 98 extending upwardly through its corresponding opening in the arrestor plate 24 (see FIG. 24) and in its upper limit position, the balance of the temperature sensing system 200 is operatively installed as follows. The base portion 206 of the frame structure 204 is lowered onto the top side of the arrestor plate 24 in a manner causing an upper end portion of the rod 98 to pass upwardly through the circular hole 234 in the bottom wall 210 of the base portion 206. The base portion 206 is then anchored to the top side of the arrestor plate 24 by operatively extending the fasteners 232 (see FIG. 20) downwardly through the bottom wall openings 230 into the arrestor plate 24.

Spring 280 is placed atop a central portion of the bottom wall 236 of the frame support portion 208, between the tabs 242 and 248 (see FIGS. 24 and 25) in a manner such that the bottom spring wall 282 overlies the top side of the bottom wall 236 and blocks the central opening 264 therein (see FIG. 22), and the spring tab 284 extends outwardly through the front tab slot 244. The heat-frangible element 202 is then snapped into place between the top frame support portion wall 258 and the top spring wall 286 (see FIGS. 24 and 25), thereby resiliently pressing the heat-frangible element 202 between the frame and spring walls 258 and 286.

This installation of the heat-frangible element 202 is illustratively accomplished by first downwardly inserting the bottom frangible element projection 278 through the opening 290 in the top spring wall 286 (see FIG. 23), depressing the top spring wall 286, tilting the upper bulb end 274 of the element 202 to position it under the top frame wall opening 260, and then releasing the element 202. This causes the vertically oriented element 202 (see FIGS. 20, 24 and 25) to be resiliently pressed between the spring 280 and the top frame wall 258, with the bottom bulb projection 278 captively retained within the top spring wall hole 290 (see FIG. 23), and a small portion of the top bulb end portion 274 extending into the top frame wall opening 260.

The assembled element, frame and spring portions 202, 208,280 form a thermal trigger subassembly 294 (see FIGS. 24 and 25) which is releasably secured to the in-place frame base portion 206 using a suitable tool 296 shown in phantom in FIG. 24. As depicted in FIG. 24, tool 296 has a horizontally oriented cylindrical handle portion 298 from which a longitudinally spaced pair of drive rods 300,302 transversely project in a downward direction parallel to a vertical axis 304. Lower end portions 300*a*,302*a* of the rods 300,302 (configured for receipt in the bottom wall openings 268) have laterally reduced cross-sections which create downwardly facing shoulders 300*b*,302*b* on the rods 300,302 at the tops of the lower end portions 300*a*,302*a*.

To install the thermal trigger subassembly 294 on the in-place frame base portion 206, the bottom wall 236 of the frame support portion 208 is positioned atop the rod 98 in a manner such that the upper end of the rod 98 passes upwardly through the annular collar 266 (see FIG. 25) and bears against the bottom side of the bottom spring wall 282, and the axis 262 is at an angle to the axis 228, with the bottom wall end portion 252 being positioned forwardly of the front side edge 212 of the bottom frame wall 210, and the bottom wall end portion 250 being positioned rearwardly of the rear side edge 214 of the bottom frame wall 219.

With an operator grasping the tool handle 298, the lower tool rod ends 300*a*,302*a* are then placed in the openings 268 of the bottom wall 236 of the frame support portion 208 in a manner causing the rod shoulders 300*b*,302*b* to bear against the top side of the bottom wall 236. The tool 296 is then forced downwardly to drive the thermal trigger subassembly 294 downwardly toward the bottom wall 210 of the frame base portion 206, depressing the rod 98 against the resilient upward force of the damper spring 92 (see FIG. 19), until the bottom wall 236 of the frame support portion 208 is vertically brought to the level of the slots 220,224 in the vertical end tabs 216,218.

The tool 296 is then rotated in a counterclockwise direction (as viewed from above) about the vertical axis 304, as indicated by the arrow 306 in FIG. 24, to cause the end portions 250,252 of the bottom wall 236 of the frame support portion 208 to be respectively rotated into the end tab slots 220,224 and underlie the top side edges of their vertically enlarged portions 222,226. Tool 296 is then lifted out of engagement with the bottom wall 236 to thereby permit the damper spring 92, via the rod 98) to drive the bottom wall end portions 250,252 upwardly against the top side edges of the slot portions 222,226 and thereby captively retain the end portions 250,252 within the slots 220,224 and bring the temperature sensing structure 200 to its fully assembled state depicted in FIG. 20, with the rod 98 upwardly bearing against the bottom wall 282 of the spring 280 (see FIG. 23), and the heat frangible element 202 blockingly preventing the rod 98 from moving upwardly from its illustrated position in which the shutoff damper 88 is in its solid line open position shown in FIG. 19.

Figure 20A:
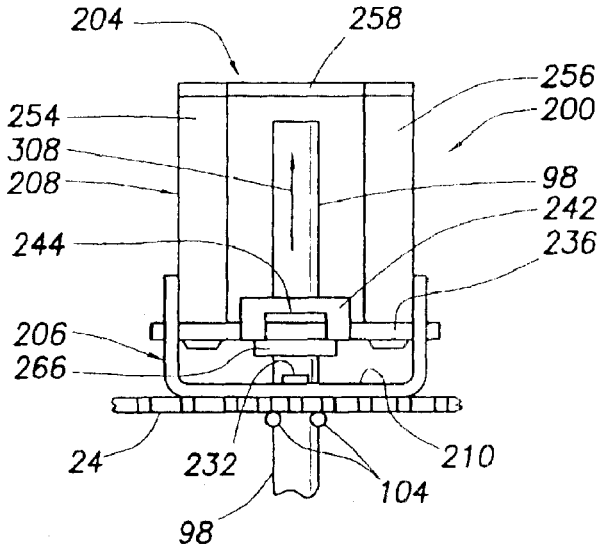
FIG. 20A is a view similar to that in FIG. 20, but with the heat-frangible temperature structure in a post-activation orientation.

If the set point temperature within the combustion chamber 18 (for example, 430 degrees F.) is reached, the bulb 270 shatters and unblocks the upper end of the rod 98, permitting the damper spring 92 to upwardly drive the rod 98, as indicated by the arrow 308 in FIG. 20A, to its upper limit position shown in FIG. 20*a*. This causes the rod 98 to eject the spring 280 from the frame 204, and the shutoff damper 88 to be driven by spring 92 to its dotted line closed position shown in FIG. 19.

To subsequently reset the combustion air shutoff system 86 after this occurs, the frame support portion 208 is simply removed from the underlying frame base portion 206, and another heat-frangible element 202 and spring 280 are installed in the frame support portion 208 to form the previously described thermal trigger subassembly 294 which is then reinstalled on the underlying frame base portion 206 as also previously described.

The heat-frangible temperature sensing structure 200 provides several advantages over the eutectic-based temperature sensing structures previously described herein. For example, the glass bulb 270 is chemically inert and not subject to thermal creep. Additionally, the temperature sensing structure 200, due to its assembly configuration, is easy to reset if the need arises to do so. Moreover, due to the method used to construct the heat-frangible element 202 it is easier to precisely manufacture-in a given trigger or set point temperature of the temperature sensing structure 200.

Figure 26:
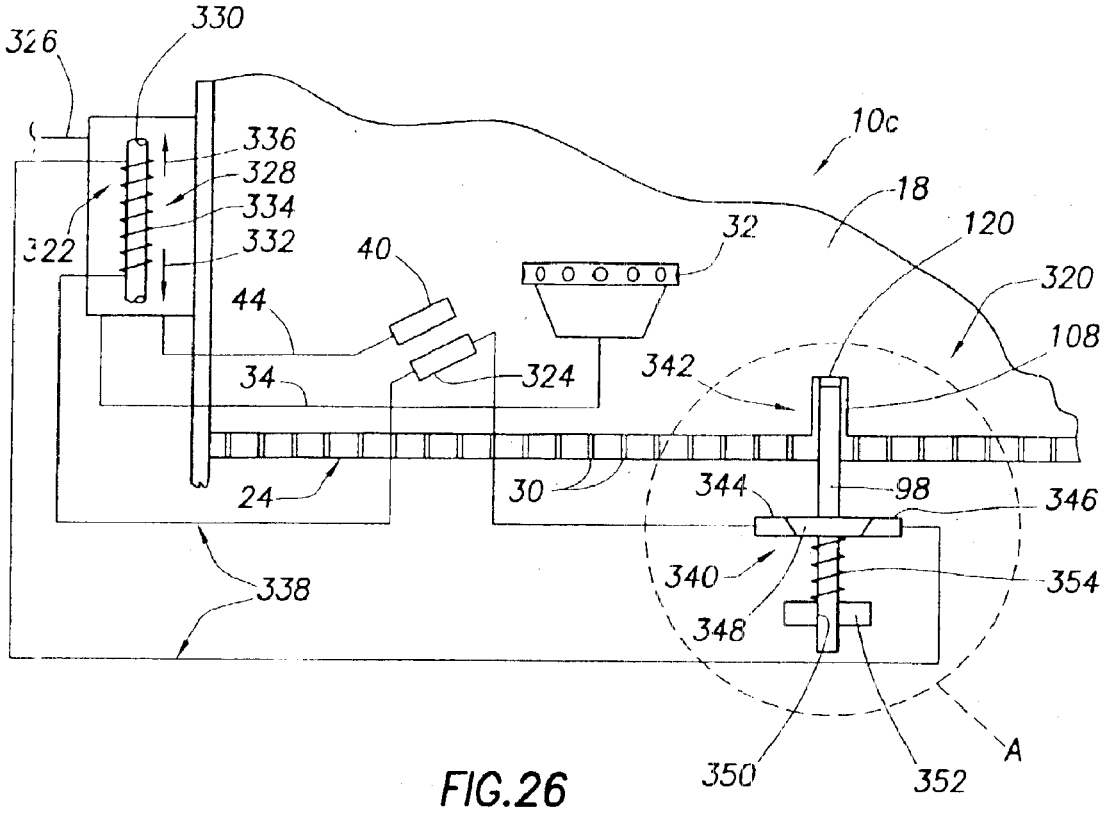
FIG. 26 is a schematic cross-sectional view through the combustion chamber portion of a gas-fired water heater similar to that shown in FIG. 1 but having incorporated therein a eutectic-based fuel valve shutoff system instead of a combustion air shutoff system, a eutectic thermal trigger structure portion of the system being shown in its untriggered position.

Schematically depicted in cross-section in FIG. 26 is a lower, combustion chamber end portion of a further embodiment 10*c* of the previously described water heater 10 shown in FIGS. 1 and 2. Representatively, water heater 10*c* is identical to water heater 10 with the exception that the water heater 10*c* is provided with a different combustion shutoff system 320. Unlike the previously described combustion shutoff system 86 incorporated in water heater 10, the combustion shutoff system 320 does not function to shut off further combustion air flow into the combustion chamber 18 in response to the sensing of a predetermined elevated temperature within the combustion chamber 18 during firing of the water heater 10*c*.

Instead, as will now be described, the combustion shutoff system 320 functions to shut off further fuel flow to the main/pilot burner structure 32,40, thereby terminating further combustion within the combustion chamber 18, in response to a temperature within the combustion chamber 18 reaching a level correlated to and indicative of a predetermined, undesirably high concentration of carbon monoxide in the combustion chamber 18. Illustratively, but not by way of limitation, this carbon monoxide concentration level is in the range of from about 200 ppm to about 400 ppm by volume.

In addition to the main and pilot gas burners 32 and 40, the water heater 10*c* also incorporates therein a thermostatic gas valve 322 (which is also present, but not illustrated in the previously described water heater 10) and a thermocouple 324 operatively associated with the pilot burner 40 in a conventional manner. Gas valve 322 is of a conventional, normally closed type, is appropriately mounted on the exterior of the water heater 10*c*, has an inlet coupled to a main gas supply pipe 326, and has an outlet side coupled to the main and pilot burner gas supply pipes 34 and 44.

The normally closed gas valve 322 has a solenoid actuating portion 328 that includes a vertically movable metal rod 330 which is downwardly biased, as indicated by the arrow 332, to a position in which it closes the valve 322 and thereby terminates gas flow from the valve to the main and pilot burners 32,40. The solenoid actuating portion 328 also includes an electrically conductive wire solenoid winding 334 that circumscribes the rod 330. When sufficient electrical current is passed through the winding 334 it creates on the rod 330 an electromagnetic force which moves the rod 330 upwardly, as indicated by the arrow 336, to thereby open the valve 322 and permit gas flow therethrough from the main gas supply pipe 326 to the main and pilot burners 32 and 40.

The combustion shutoff system 320 includes an electrical wiring circuit 338 in which the solenoid winding 334, the thermocouple 324 and a normally closed switch structure 340 are connected in series as shown in FIG. 26, and a temperature sensing structure 342 projecting upwardly through the arrestor plate 24 into the interior of the combustion chamber 18 adjacent the main burner 32.

The temperature sensing structure 342, which directly senses a temperature within the combustion chamber 18 near the main burner 32, is mechanically associated with the switch structure 340 in a manner subsequently described herein, and is similar in construction to the previously described temperature sensing structure 100 shown in FIGS. 1, 2 and 4. Specifically, the temperature sensing structure 342 includes the tubular collar member 108 projecting upwardly through a suitable opening in the arrestor plate 24 and slidably receiving an upper end portion of the rod 98, the upper end of rod 98 being blocked by the eutectic disc member 120 captively retained in the open upper end of the collar 108. Alternatively, this upper end portion of the eutectic-based temperature sensing structure 342 may have a configuration similar to that of one of the previously described eutectic-based temperature sensing structures 100*a* (FIG. 4A), 100*b* (FIG. 10), 100*c* (FIG. 11), 100*d* (FIG. 12), or other suitable configuration.

Normally closed switch structure 340 includes schematically depicted, spaced apart contact portions 344,346 fixedly secured in the wiring of the circuit 338, and a central contact portion 348 anchored to a longitudinally intermediate portion of the rod 98 for vertical movement therewith and releasably engageable with the contacts 344,346 to close the switch 340. A lower end portion of the rod 98 is slidingly received in an opening 350 extending through a schematically depicted fixed support structure 352. A coiled compression spring 354 encircles the rod 98, with the upper and lower ends of the spring 354 respectively bearing against the underside of the central contact 348 and the top side of the support structure 352. Spring 354 thus resiliently biases the rod 98 in an upward direction.

With the temperature sensing structure 342 in its FIG. 26 position the eutectic element 120 is intact and holds the rod 98 in its lower limit position in which the central switch contact 344 is held against the contacts 344 and 346, with the spring 354 being held in a vertically compressed state, thereby closing the circuit 338. Still referring to FIG. 26, during normal firing of the water heater 10*c*, impingement of the flame from the pilot burner 40 on the thermocouple 324 causes the thermocouple to thermoelectrically generate an electrical current through the closed circuit 338. This thermoelectrically generated electrical current, in turn, causes the solenoid winding 334 to create an electromagnetic force that upwardly shifts the metal valve rod 330 to thereby maintain the normally closed gas valve 322 in its open position to correspondingly maintain gas flow to the burners 32 and 40.

Figure 26A:
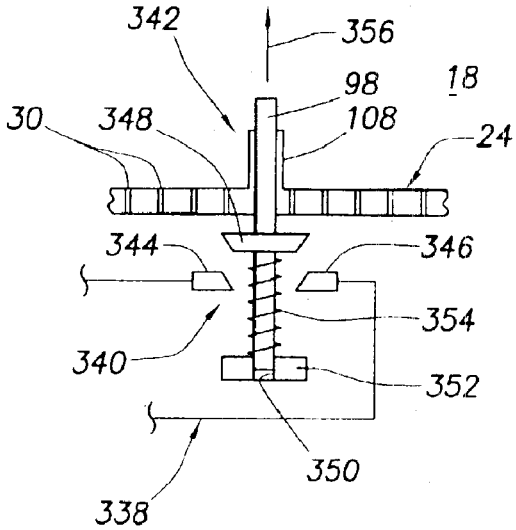
FIG. 26A is a schematic detail view of the dashed circle area "A" in FIG. 26 and illustrates the thermal trigger in its triggered orientation.

In the event that the temperature sensing structure 342 is exposed to an elevated combustion temperature which is correlated to and indicative of a predetermined, undesirably high concentration of carbon monoxide within the combustion chamber 18, the eutectic element 120 melts, thereby permitting the spring 354 to upwardly drive the rod 98, as indicated by the arrow 356, to its FIG. 26A upper limit position in which the central switch contact 348 is lifted off its associated switch contacts 344 and 346, thereby opening the switch 340 and thus opening the circuit 338. The opening of the circuit 338, in turn, terminates current flow through the solenoid winding 334 (se FIG. 26), thereby closing the gas valve 322 and terminating further gas supply to the burners 32,30 and shutting down combustion within the combustion chamber 18.

Figure 27:
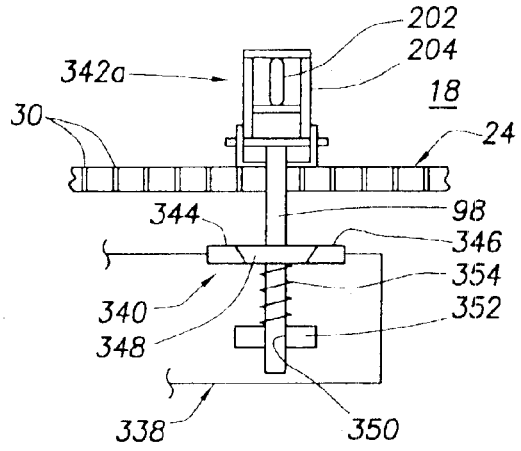
FIG. 27 is a view similar to that in FIG. 26A but illustrating a frangible element-based thermal trigger structure, shown in its untriggered orientation, used in place of the eutectic-based thermal trigger shown in FIGS. 26 and 26A.

FIG. 27 schematically depicts an alternate embodiment 342*a* of the FIG. 26 temperature sensing structure 342. In the altered temperature sensing structure 342*a*, the eutectic-based upper end portion 108,120 of the temperature sensing structure 342 disposed within the combustion chamber 18 is replaced with the previously described frangible, fluid-containing bulb 202 and associated frame structure 204 shown in FIGS. 19–25. When the bulb 202 is heat shattered, by exposure to a combustion chamber temperature indicative of and correlated to a predetermined, undesirably high carbon monoxide concentration within the combustion chamber 18, the rod 98 is spring-driven upwardly away from its FIG. 27 position, thereby opening the circuit 338 to thereby terminate further gas flow to the burners 32 and 40.

Figure 28:
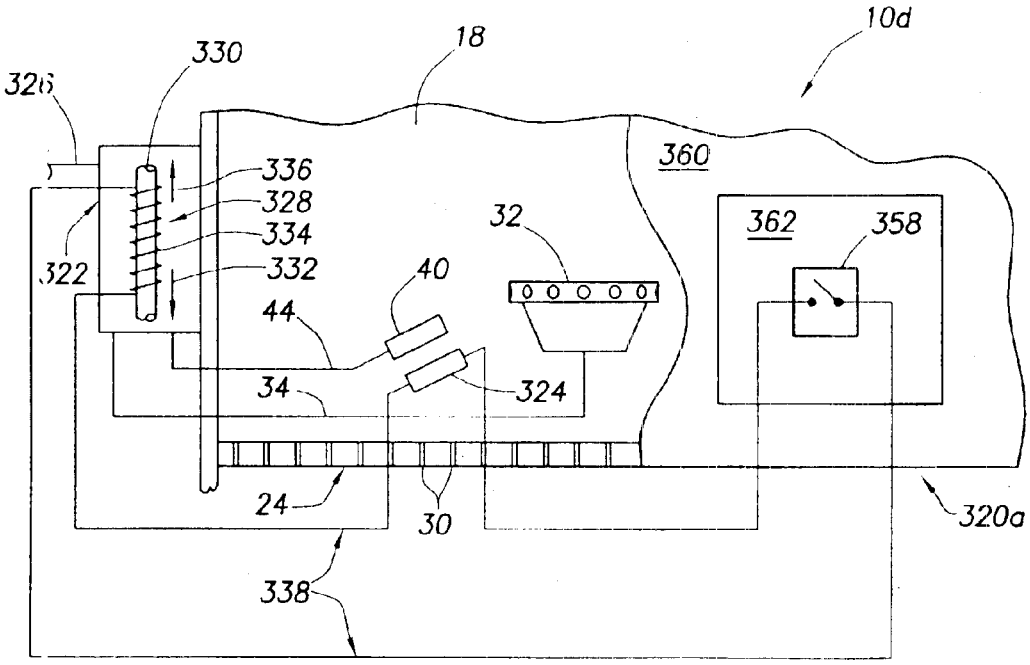
FIG. 28 is a schematic, partly elevational cross-sectional view through a combustion chamber portion of a gas-fired water heater similar to that shown in FIG. 26 but incorporating therein an alternate, thermally actuated switch-based fuel valve shutoff system.

Schematically depicted in FIG. 28 is a lower, combustion chamber end portion of an alternate embodiment 10*d* of the previously described water heater 10*c* shown in FIG. 26. Water heater 10*d* is identical to the previously described water heater 10*c* with the exception that it is provided with a modified combustion shutoff system 320*a* operative to shut off gas flow to the burner structure 32,40 in response to an undesirably high concentration of carbon monoxide within the combustion chamber 18.

Combustion shutoff system 320*a* is identical to the previously described combustion shutoff system 320 with the exception that the temperature sensing structure 342 which projects upwardly into the interior of the combustion chamber 18 to directly sense a combustion temperature therein, and the associated switch structure 340 mechanically linked thereto, are replaced with a conventional, normally closed thermally actuated switch 358 which is connected in the circuit 338 in series with the thermocouple 324 and the solenoid winding 334. Representatively, but not by way of limitation, the switch 358 is a bimetallic type of thermally actuated switch.

The combustion chamber 18 has a metal vertical outer wall portion 360 that includes an access door 362 illustratively positioned adjacent the main burner 32 and operative to provide selective access to the interior of the combustion chamber 18. The switch 358 is mounted on the outer side of the metal access door 352, in thermal communication therewith, to thereby indirectly sense a combustion temperature adjacent the inner side of the access door 362. Alternatively, the switch 358 could be mounted externally on another outer wall portion of the combustion chamber 18.

The actuation temperature of the switch 358 (i.e., a temperature which will open it) is selected in a manner such that when the combustion chamber temperature adjacent the inner side of the access door 362 reaches a level correlated to and indicative of the presence of an undesirable carbon monoxide level within the combustion chamber 18, the switch 358 will be subjected to its actuation temperature, thereby opening. This heat-actuated opening of the switch 358 in turn opens the circuit 338 to thereby terminate gas flow to the burners 32,40 and shutoff further combustion in the combustion chamber 18.

While principles of the present invention have been illustrated and described herein as being representatively incorporated in a gas-fired water heater, it will readily be appreciated by those skilled in this particular art that such principles could also be employed to advantage in other types of fuel-fired heating appliances such as, for example, furnaces, boilers and other types of fuel-fired water heaters. Additionally, while a particular type of combustion air inlet flow path has been representatively illustrated and described in conjunction with the water heaters 10, 10*a* and 10*b*, it will also be readily appreciated by those skilled in this art that various other air inlet path and shutoff structure configurations could be utilized, if desired, to carry out the same general principles of the present invention. Moreover, while several types of thermal trigger devices have been representatively utilized in the water heaters 10–10*d* to shut off their associated gas valves, or further combustion air flow thereto, it will be readily appreciated by those of skill in this particular art that a variety of other types of thermal trigger devices could be alternatively utilized if desired.

The foregoing detailed description is to be clearly understood as being given by way of illustration and example only, the spirit and scope of the present invention being limited solely by the appended claims.

What is claimed is:

1. Fuel-fired heating apparatus comprising:

a combustion chamber thermally communicatable with a fluid to be heated;

combustion apparatus operative to burn a fuel-air mixture within said combustion chamber; and a combustion shutoff system operative to sense a temperature in said combustion chamber and responsively terminate further combustion therein in response to said temperature reaching a level correlated to and indicative of a predetermined, undesirably high concentration of carbon monoxide present in said combustion chamber, said combustion shutoff system being operative to directly sense said temperature within said combustion chamber and including a temperature sensing structure extending into the interior of said combustion chamber, said temperature sensing structure including a frangible structure heat shatterable at said temperature, and said combustion shutoff system being operative in response to shattering of said frangible structure.

2. The fuel-fired heating apparatus of claim 1 wherein:

said fuel-fired heating apparatus is a fuel-fired water heater.

3. The fuel-fired heating apparatus of claim 1 wherein:

said fuel-fired heating apparatus is a gas-fired water heater.

4. The fuel-fired heating apparatus of claim 1 wherein:

said frangible structure includes a glass bulb containing a fluid.

5. The fuel-fired heating apparatus of claim 4 wherein:

the fluid is peanut oil.

6. The fuel-fired heating apparatus of claim 4 wherein:

the fluid is mineral oil.

7. The fuel-fired heating apparatus of claim 4 wherein:

the fluid is an assembly lubricant.

8. The fuel-fired heating apparatus of claim 1 wherein:

said combustion apparatus includes a fuel burner, a fuel supply conduit operatively connected to said fuel burner, and a fuel valve connected in said fuel supply conduit, and said combustion shutoff system is operative, in response to said temperature reaching said level, to close said fuel valve and thereby prevent fuel supply to said fuel burner.

9. The fuel-fired heating apparatus of claim 1 wherein:

said predetermined, undesirably high concentration of carbon monoxide present in said combustion chamber is in the range of from about 200 ppm to about 400 ppm by volume.

10. Fuel-fired heating apparatus comprising:

a combustion chamber thermally communicatable with a fluid to be heated;

a burner structure disposed within said combustion chamber;

a fuel valve coupled to said burner structure for supplying fuel thereto;

an electrical circuit in which said fuel valve is connected, said electrical circuit being openable to prevent said fuel valve from supplying fuel to said burner structure, said burner structure having a thermocouple associated therewith, said thermocouple being disposed in series with said fuel valve within said electrical circuit; and a temperature sensing structure operative to sense a temperature within said combustion chamber and responsively open said electrical circuit in response to said temperature reaching a level correlated to and indicative of a predetermined, undesirably high concentration of carbon monoxide present in said combustion chamber, said temperature sensing structure including a normally closed switch connected in series with said thermocouple and said fuel valve in said electrical circuit, said switch being openable, to thereby open said electrical circuit, in response to said temperature within said combustion chamber reaching said level, said temperature sensing structure having a portion projecting into said combustion chamber, being coupled to said switch and being movable, in a manner opening said switch, in response to said temperature within said combustion chamber reaching said level, said portion of said temperature sensing structure including a frangible, fluid-containing member heat shatterable in response to said temperature within said combustion chamber reaching said level.

11. The fuel-fired heating apparatus of claim 10 wherein:

said frangible, fluid containing member is a glass bulb containing peanut oil.

12. The fuel-fired heating apparatus of claim 10 wherein:

said frangible, fluid containing member is a glass bulb containing mineral oil.

13. The fuel-fired heating apparatus of claim 10 wherein:

said frangible, fluid containing member is a glass bulb containing an assembly lubricant.

14. The fuel-fired heating apparatus of claim 10 wherein:

said fuel-fired heating apparatus is a fuel-fired water heater.

15. The fuel-fired heating apparatus of claim 10 wherein:

said fuel-fired heating apparatus is a gas-fired water heater.

16. The fuel-fired heating apparatus of claim 10 wherein:

said predetermined, undesirably high concentration of carbon monoxide present in said combustion chamber is in the range of from about 200 ppm to about 400 ppm by volume.

* * * * *